US011401949B2

(12) United States Patent
Fukumasu et al.

(10) Patent No.: US 11,401,949 B2
(45) Date of Patent: Aug. 2, 2022

(54) BLOWER

(71) Applicant: Iris Ohyama Inc., Sendai (JP)

(72) Inventors: Kazuhito Fukumasu, Kakuda (JP); Hirokazu Fujii, Kakuda (JP); Hideki Yamamoto, Kakuda (JP); Kanako Tsutsumi, Kakuda (JP)

(73) Assignee: IRIS OHYAMA INC., Sendai (JP)

( * ) Notice: Subject to any disclaimer, the term of this patent is extended or adjusted under 35 U.S.C. 154(b) by 0 days.

(21) Appl. No.: 17/283,228

(22) PCT Filed: Oct. 3, 2019

(86) PCT No.: PCT/JP2019/039042
§ 371 (c)(1),
(2) Date: Apr. 6, 2021

(87) PCT Pub. No.: WO2020/075606
PCT Pub. Date: Apr. 16, 2020

(65) Prior Publication Data

US 2021/0348623 A1 Nov. 11, 2021

(30) Foreign Application Priority Data

Oct. 10, 2018 (JP) ..... JP2018-192033

(51) Int. Cl.
*F04D 29/54* (2006.01)
*F04D 25/08* (2006.01)
(Continued)

(52) U.S. Cl.
CPC ..... *F04D 29/547* (2013.01); *F04D 25/08* (2013.01); *F04D 29/522* (2013.01); *F04D 29/644* (2013.01)

(58) Field of Classification Search
CPC ..... F04D 25/08–25/14; F04D 25/10; F04D 25/105; F04D 29/522; F04D 29/547; F04D 29/644
See application file for complete search history.

(56) References Cited

U.S. PATENT DOCUMENTS 1,551,278 A * 8/1925 Aalborg ..... F04D 25/105 74/43
2,667,301 A * 1/1954 Lautnermaxe ..... F04D 29/646 417/361
(Continued)

FOREIGN PATENT DOCUMENTS

CN 102108974 A 6/2011
CN 205064330 U 3/2016
(Continued)

OTHER PUBLICATIONS

Machine Translation of JP 2011-208910, accessed Jan. 2022 (Year: 2011).*
(Continued)

*Primary Examiner* — Justin D Seabe
*Assistant Examiner* — Julian B Getachew
(74) *Attorney, Agent, or Firm* — Studebaker & Brackett PC

(57) ABSTRACT

A blower according to a present embodiment includes a blower unit that has a housing on which a slit is formed to extend vertically, and a support unit that has a support pillar inserted through the slit and pivotally coupled with the blower unit to be swingable vertically. And, by forming a distance between a lower end of the slit and the support pillar in a horizontally directed state in which an airflow direction of the blower unit is in line with a horizontal direction, it is configured to make the blower unit swingable
(Continued)

such that the airflow direction of the blower unit is directed toward a lower side below the horizontal direction.

15 Claims, 25 Drawing Sheets

(51) Int. Cl.
*F04D 29/52* (2006.01)
*F04D 29/64* (2006.01)

(56) References Cited

U.S. PATENT DOCUMENTS

| | | | | |
|---|---|---|---|---|
| 4,732,539 | A * | 3/1988 | Shin-Chin | F04D 25/105 403/73 |
| 4,856,968 | A | 8/1989 | Armbruster | |
| 5,609,473 | A * | 3/1997 | Litvin | F04D 29/601 416/244 R |
| 7,316,540 | B2 * | 1/2008 | Russak | F04D 25/08 248/125.7 |
| 2020/0208871 | A1 | 7/2020 | Yamamoto et al. | |

FOREIGN PATENT DOCUMENTS

| | | | |
|---|---|---|---|
| CN | 107842519 | A | 3/2018 |
| JP | 2001-252147 | A | 9/2001 |
| JP | 2008-069520 | A | 3/2008 |
| JP | 2011-208910 | A | 10/2011 |
| JP | 2014-005787 | A | 1/2014 |
| JP | 5568171 | B2 | 8/2014 |
| JP | 2014-167302 | A | 9/2014 |
| JP | 2016-033344 | A | 3/2016 |
| JP | 3206931 | U | 10/2016 |
| JP | 6363811 | B1 | 7/2018 |
| KR | 20-2018-0002478 | U | 8/2018 |

OTHER PUBLICATIONS

International Search Report issued in PCT/JP2019/039042; dated Dec. 17, 2019.

"Notice of Reasons for Refusal" Office Action issued in JP 2018-192033; mailed by the Japanese Patent Office dated Aug. 6, 2019.

"Notice of Reasons for Refusal" Office Action issued in JP 2018-192033; mailed by the Japanese Patent Office dated Dec. 10, 2019.

"Decision to Grant a Patent" Office Action issued in JP 2018-192033; mailed by the Japanese Patent Office dated Mar. 24, 2020.

"Notice of Reasons for Refusal" Office Action issued in JP 2020-016515; mailed by the Japanese Patent Office dated May 12, 2020.

"Notice of Reasons for Refusal" Office Action issued in JP 2020-016515; mailed by the Japanese Patent Office dated Aug. 18, 2020.

"Decision to Grant a Patent" Office Action issued in JP 2020-016515; mailed by the Japanese Patent Office dated Oct. 20, 2020.

"Notice of Reasons for Refusal" Office Action issued in JP 2020-190380; mailed by the Japanese Patent Office dated Jan. 12, 2021.

"Decision to Grant a Patent" Office Action issued in JP 2020-190380; mailed by the Japanese Patent Office dated Feb. 16, 2021.

* cited by examiner

BLOWER

TECHNICAL FIELD

The present invention relates to a blower such as an air circulator.

BACKGROUND ART

Heretofore, as a blower capable of swinging vertically, know is an air circulator having a structure in which a casing of its blower unit is supported by two support pillars (see Patent Document 1).

The air circulator disclosed in the Patent Document 1 has the structure in which the two support pillars are stood on a base with being distanced with a wider distance than a width of the blower unit and the blower unit is pivotally supported between the two support pillars. Therefore, the width of the base has to become wider than the blower unit, and thereby the device is hard to be down-sized.

Therefore, proposed is an air circulator in which slits are formed on a casing of its blower unit and the blower unit is supported within the casing by support pillars provided on a base and inserted through the slits (see Patent Document 2).

According to the structure explained above, the circulator can be designed as being compact.

PRIOR ART DOCUMENT

Patent Document

Patent Document 1: Japanese Granted Patent Publication No. 5568171

Patent Document 2: Japanese Granted Patent Publication No. 6363811

SUMMARY OF THE INVENTION

Problem to be Solved by the Invention

However, the air circulator disclosed in the Patent Document 2 can be designed as being compact, but its vertical swinging range is limited to an angle range from a horizontal direction to an obliquely upward direction. Therefore, when the air circulator is placed on a shelf, a windowsill or the like, it cannot send its airflow downward below the horizontal direction.

As explained above, according to the conventional structure, a swinging downward below the horizontal direction (with a depression angle) cannot be achieved while making the device compact.

An embodiment of the present embodiment provides a blower that can send airflow downward below the horizontal direction while making the device compact.

Means for Solving the Problem

An aspect of the present invention provides a blower comprising: a blower unit that has a housing on which a slit is formed to extend vertically; and a support unit that has a support pillar inserted through the slit and pivotally coupled with the blower unit to be swingable vertically, wherein a distance is formed between a lower end of the slit and the support pillar in a horizontally directed state in which an airflow direction of the blower unit is in line with a horizontal direction to make the blower unit swingable such that the airflow direction of the blower unit is directed toward a lower side below the horizontal direction.

Advantageous Effects of the Invention

According to the aspect of the present invention, it is possible to provide a blower that can send airflow downward below the horizontal direction while making the device compact.

EMBODIMENT FOR CARRYING OUT THE INVENTION

Figure 1:
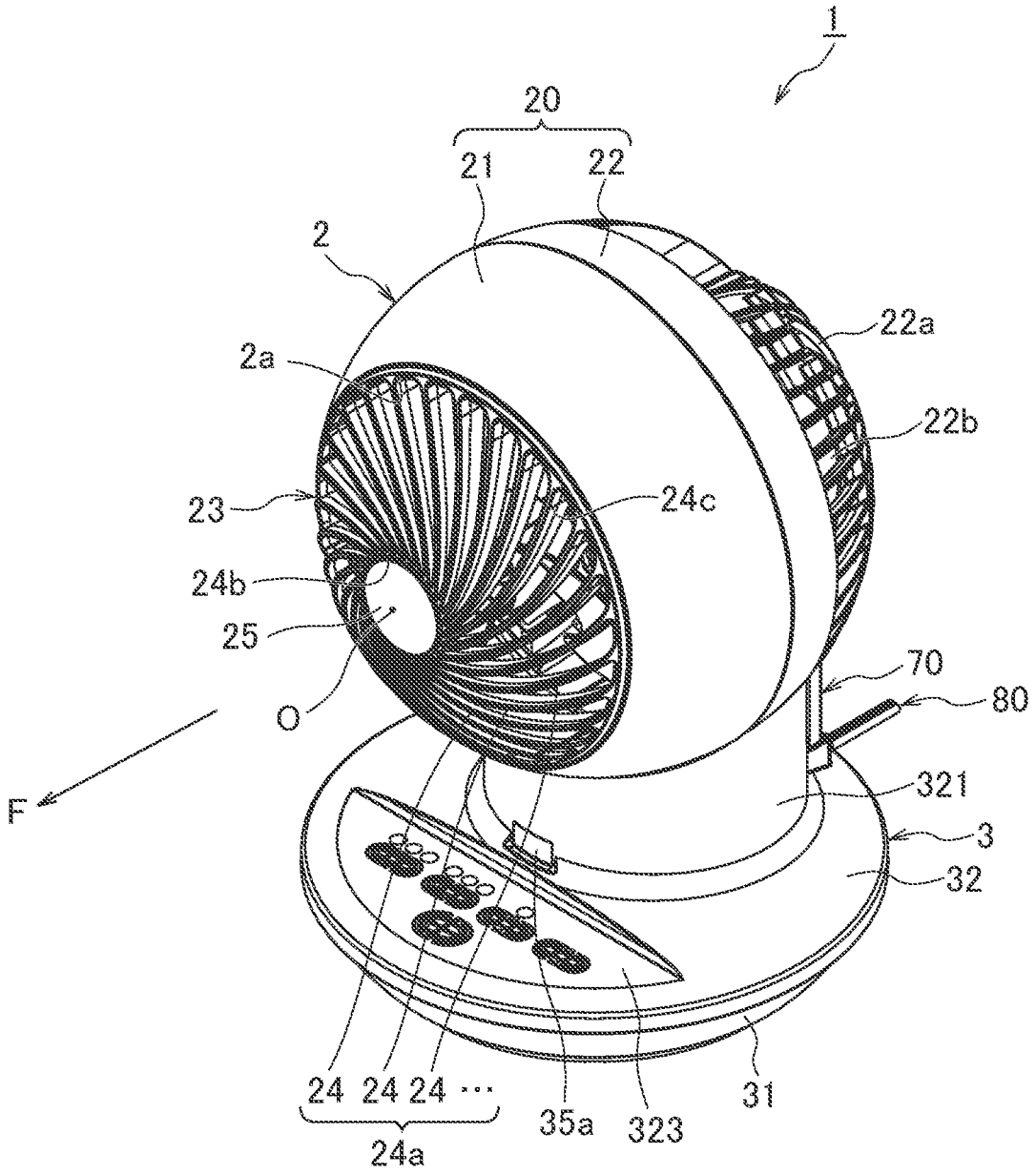
FIG. 1 It is a perspective view showing a horizontally directed state of a blower according to a present embodiment.

Hereinafter, an embodiment of the present invention will be explained in detail with reference to the drawings. Note that, in the drawings, identical or equivalent portions to each other are labelled with identical or equivalent signs to them. However, it should be kept in mind that the drawings are schematic and relations between thickness and its planar dimension, proportions of thicknesses of layers and so on may be different from their actual ones. Therefore, specific thicknesses and dimensions should be understood in consideration of following explanations. In addition, of course, the drawings may include portions whose relations and proportions of dimensions are different from their actual ones.

Overview

A structure of an air circulator for supporting its blower unit 2 by support pillars 33 within its cover (housing) 20 enables swinging downward below a horizontal direction.

Appearance

Figure 2:
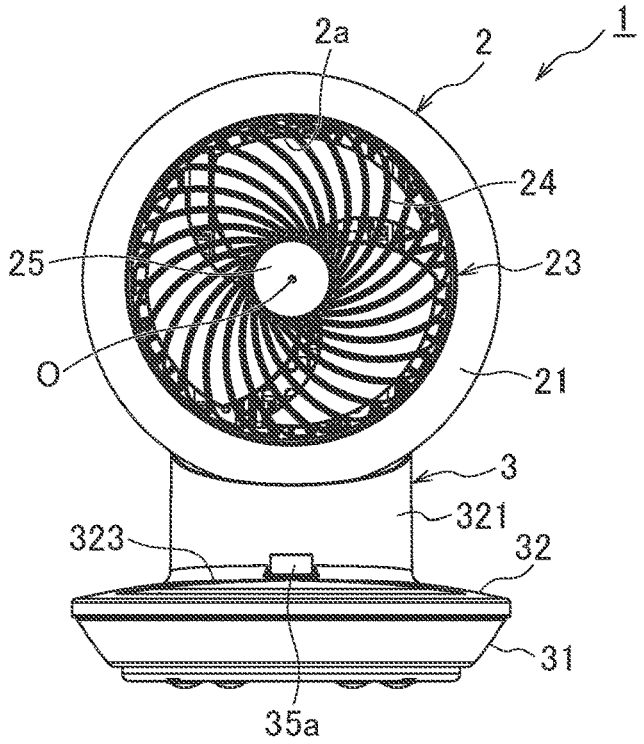
FIG. 2 It is a front view showing the horizontally directed state of the blower according to the present embodiment.
Figure 3:
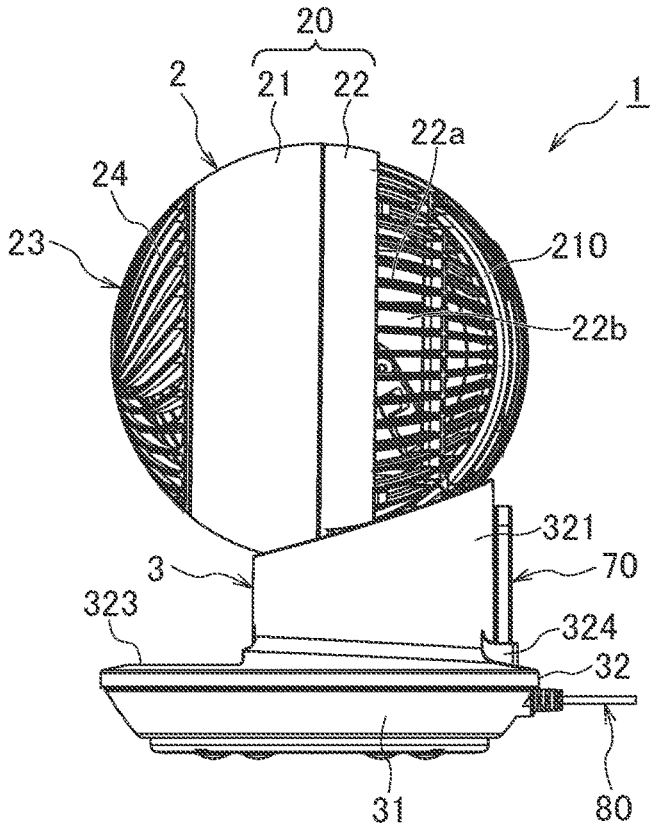
FIG. 3 It is a right side view showing the horizontally directed state of the blower according to the present embodiment.
Figure 4:
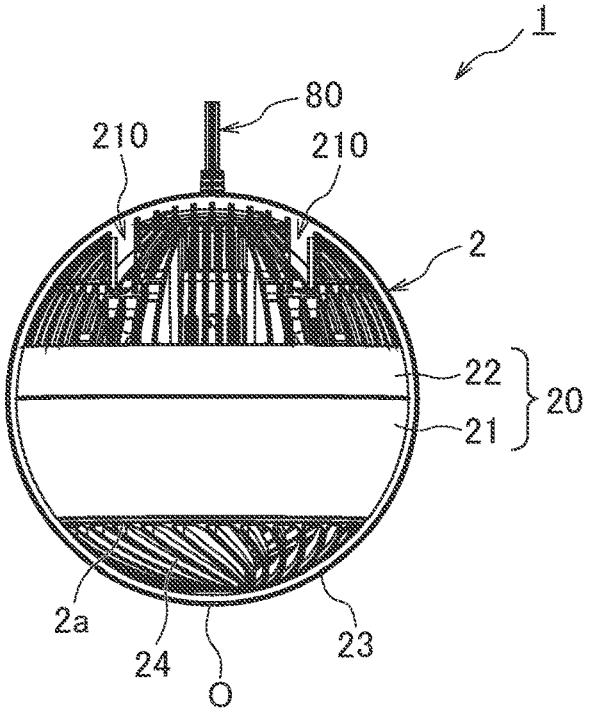
FIG. 4 It is a plan view showing the horizontally directed state of the blower according to the present embodiment.
Figure 5:
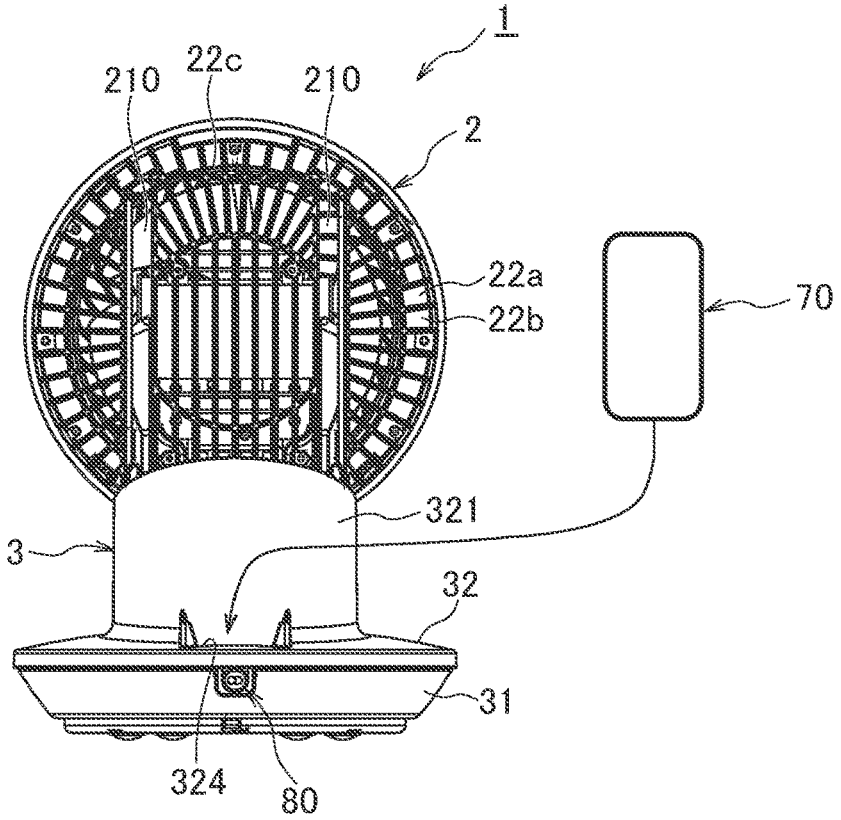
FIG. 5 It is a back view showing the horizontally directed state of the blower according to the present embodiment.

FIG. 1 to FIG. 5 are appearance views showing a blower 1 according to the present embodiment, and FIG. 1 is its perspective view, FIG. 2 is its front view, FIG. 3 is its right side view, FIG. 4 is its plan view and FIG. 5 is its back view. This blower 1 intends to improve its airflow speed by its spherical grill structure, and is configured to be seen as being compact by its advanced spherical design.

Specifically, as shown in FIG. 1 to FIG. 5, the blower 1 according to the present embodiment includes a blower unit 2 that is provided with a grill 23 on whose front side an airflow opening 2*a* is formed, and a support unit 3 that supports the blower unit 2.

The grill 23 is provided with plural fins 24 in a spiral manner, and their inner end portions 24*b* closer to the center O of the spiral of the plural fins 24 are protruded in an airflow direction F from their outer end portions 24*c* made continuous to the airflow opening 2*a*. In other words, the inner end portions 24*b* are protruded in the airflow direction F with respect to the outer end portion(s) 24*c* of a portion 24*a* of the grill 23 in which the plural fins 24 are formed. Note that the portion 24*a* in which the plural fins 24 are formed is a portion got by excluding a cap 25 located at the center O of the spiral from the grill 24. The inner end portion(s) 24*b* is an inner-end side closer to the center O of the spiral and includes a vicinity of an inner end. The outer end portion(s) 24*c* is a portion of its outer-end side made continuous to the airflow opening 2*a*. According to these, airflow is concentrated (made convergent) to the center, and thereby the airflow speed at the center of the airflow direction can be improved. In addition, a reach distance of the airflow (spiral airflow) blown out from the airflow opening 2*a* can be extended. As the result, air in a room can be agitated surely to homogenize a temperature in the room, and thereby it contributes to energy savings. Note that the airflow opening 2*a* of the blower unit 2 is formed to have a circular shape.

Here in the blower 1 according to the present embodiment, the blower unit 2 is supported swingably by the support unit 3. In other words, the blower 1 according to the present embodiment includes the blower unit 2 and the support unit 3 that supports the blower unit 2 swingably.

It is preferable that this blower unit 2 has the cover (housing) 20 on which a slit(s) 210 extending vertically is formed. In addition, it is preferable that the support unit 3 has the support pillar(s) 33 that is inserted through the slit(s) 210 and pivotally holds the blower unit 2 to make it swingable vertically. According to this, the blower unit 2 can be supported by the support pillar(s) 33 within the cover (housing) 20, and thereby the blower 1 can be made compact.

Here, it is preferable that a distance D1 (see FIG. 14) is formed between a lower end(s) 210*a* of the slit(s) 210 and the support pillar(s) 33 in a horizontally directed state in which the airflow direction F of the blower unit 2 is in line with the horizontal direction (a state shown in FIG. 1 to FIG. 5) to realize a configuration for enabling swinging of the blower unit 2 such that the airflow direction F of the blower unit 2 can be directed toward a lower side below the horizontal direction. According to this, it becomes possible to direct the airflow downward below the horizontal direction.

By making the blower 1 compact as explained above, it can be easily placed on a shelf, a windowsill or the like. Further, by enabling the blower 1 to direct the airflow downward below the horizontal direction, the airflow can be directed toward a lower side than the shelf or the windowsill in a state where it is placed on the shelf, the windowsill or the like. In other words, the blower 1 according to the present embodiment can be used not only in a state where it is placed on a floor and directs its airflow toward an upper side than the floor surface but also in a state where it is placed on a shelf, a windowsill or the like and directs its airflow toward a lower side then the shelf, the windowsill or the like, and thereby flexibility of its placement can be improved.

In addition, it is preferable that, in a maximum downward swinging state where the blower unit 2 swings to a downward limit within its swingable range, it is configured such that the airflow opening 2*a* of the blower unit 2 is not blocked by the support unit 3. According to this, in the state where the blower unit 2 is swung to the downward limit within its swingable range, the airflow blown through the airflow opening 2*a* can be restricted from colliding with the support unit 3. As the result, within an entire swingable range of the blower unit 2, a volume rate of the airflow can be restricted from being weakened.

In addition, it is preferable that the cover (housing) 20 has a spherical surface 20*a* with its center on a swing axis C of the blower unit 2. Further, it is preferable that the support unit 3 has a concave spherical surface 322*a* facing to the spherical surface 20*a* to form a predetermined clearance D2 (see FIG. 15). Then, it is preferable that it is configured such that the clearance D2 between the spherical surface 20*a* of the cover (housing) 20 and the concave spherical surface 322*a* of the support unit 3 doesn't enlarge while swinging the blower unit 2. According to this, the blower unit 2 can be restricted from contacting with the support unit 3 while swinging the blower unit 2. Furthermore, it can be restricted that the clearance formed between the blower unit 2 and the support unit 3 enlarges while swinging the blower unit 2. As the result, it is restricted that an obstacle or the like is tucked between the clearance between the blower unit 2 and the support unit 3 while swinging the blower unit 2, and thereby safeness can be improved.

In addition, it is preferable that a rib 212 protruding in a width direction of the slit(s) 210 is formed on an inner face 211*c* defining a width of the slit(s) 210 in the cover (housing) 20. According to this, strength of the cover (housing) 20 can be made higher. Further, it can be restricted that a hand, a finger or the like is entered into the slit(s) 210 by forming the rib 212 at the slit 210, and thereby safeness can be improved.

In addition, it is preferable to provide a pivotally coupling mechanism 50 that restricts release of a pivotally coupling state of the blower unit 2 and the support pillar(s) 33. According to this, the blower unit 2 is configured to be swung manually, and the blower unit 2 can be restricted from being removed from the support pillar(s) 33 even when a torsional force is applied to the cover (housing) 20.

In addition, it is preferable that the cover (housing) 20 has a front cover 21 and a rear cover 22 that are dividable at a front-rear center position of the blower unit 2. According to this, productions of the front cover 21 and the rear cover 22 can become easy, and components can be easily disposed within the cover (housing) 20. In other words, assembling workability of the blower unit 2 can be improved. And, it is preferable that the slit(s) 210 is formed from a lower face to an upper face through a back face of the rear cover 22. According to this, since the slit(s) 210 is formed on the rear cover 22 that is a single member, misalignment of the slit(s) due to a dimensional error during assembling it or the like can be restricted. As the result, it becomes possible to swing the blower unit 2 smoothly.

In addition, it is preferable that the support pillar(s) 33 is disposed closer to a rear end of the support unit 3. According to this, even when the slit(s) 210 is formed on the rear cover 22 that are dividable at the front-rear center position of the blower unit 2, it becomes possible to swing the blower unit 2 such that the airflow direction F of the blower unit 2 is directed toward a lower side below the horizontal direction.

Details of Each Element

Figure 7:
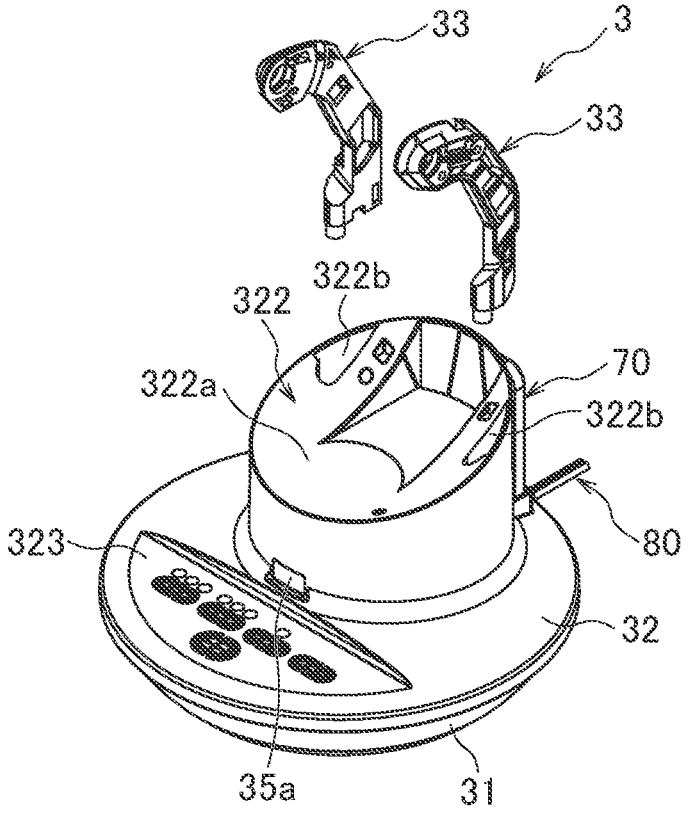
FIG. 7 It is an exploded perspective view of a support unit of the blower according to the present embodiment.
Figure 8:
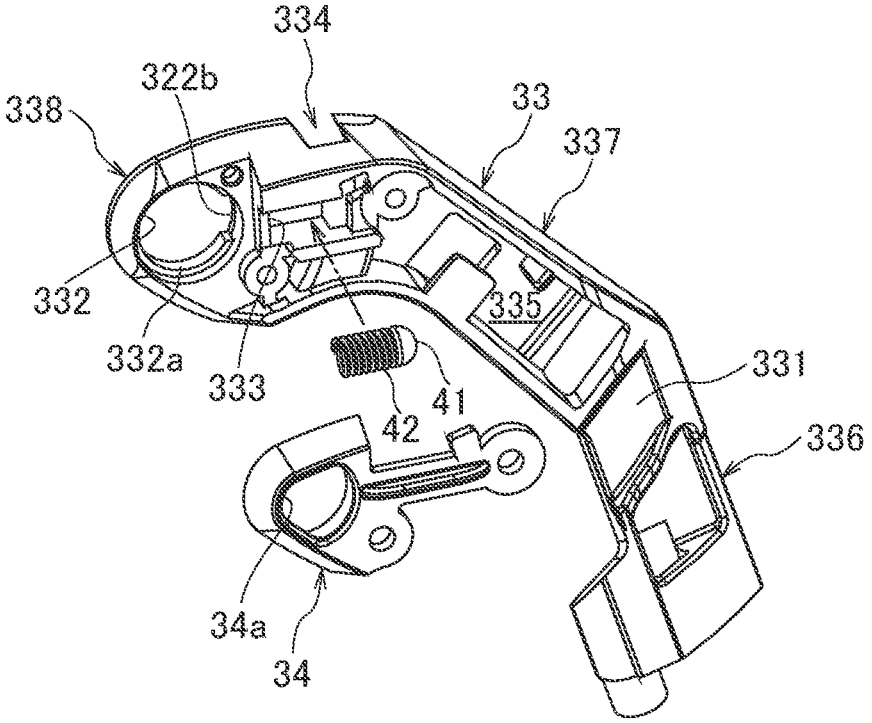
FIG. 8 It is an exploded perspective view of a support pillar of the support unit according to the present embodiment.
Figure 9:
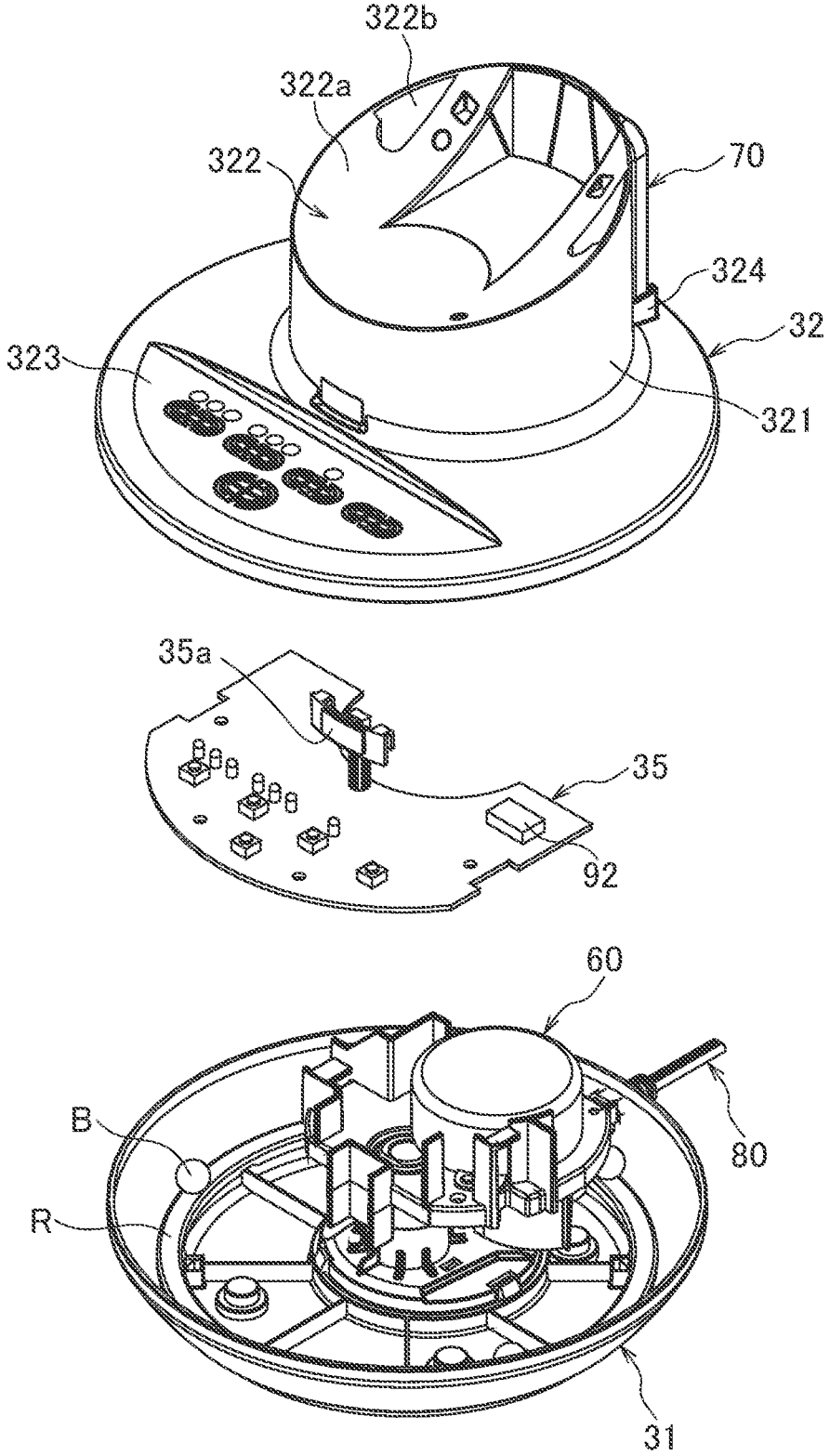
FIG. 9 It is an exploded perspective view of a main body of the support unit according to the present embodiment.

Hereinafter, the blower 1 according to the present embodiment will be explained further in detail by using FIG. 6 to FIG. 9. Here, FIG. 6 is an exploded perspective view of the blower, FIG. 7 is an exploded perspective view of the support unit of the blower, FIG. 8 is an exploded perspective view of the support pillar of the support unit, and FIG. 9 is an exploded view of a main body of the support unit.

Blower Unit

Figure 6:
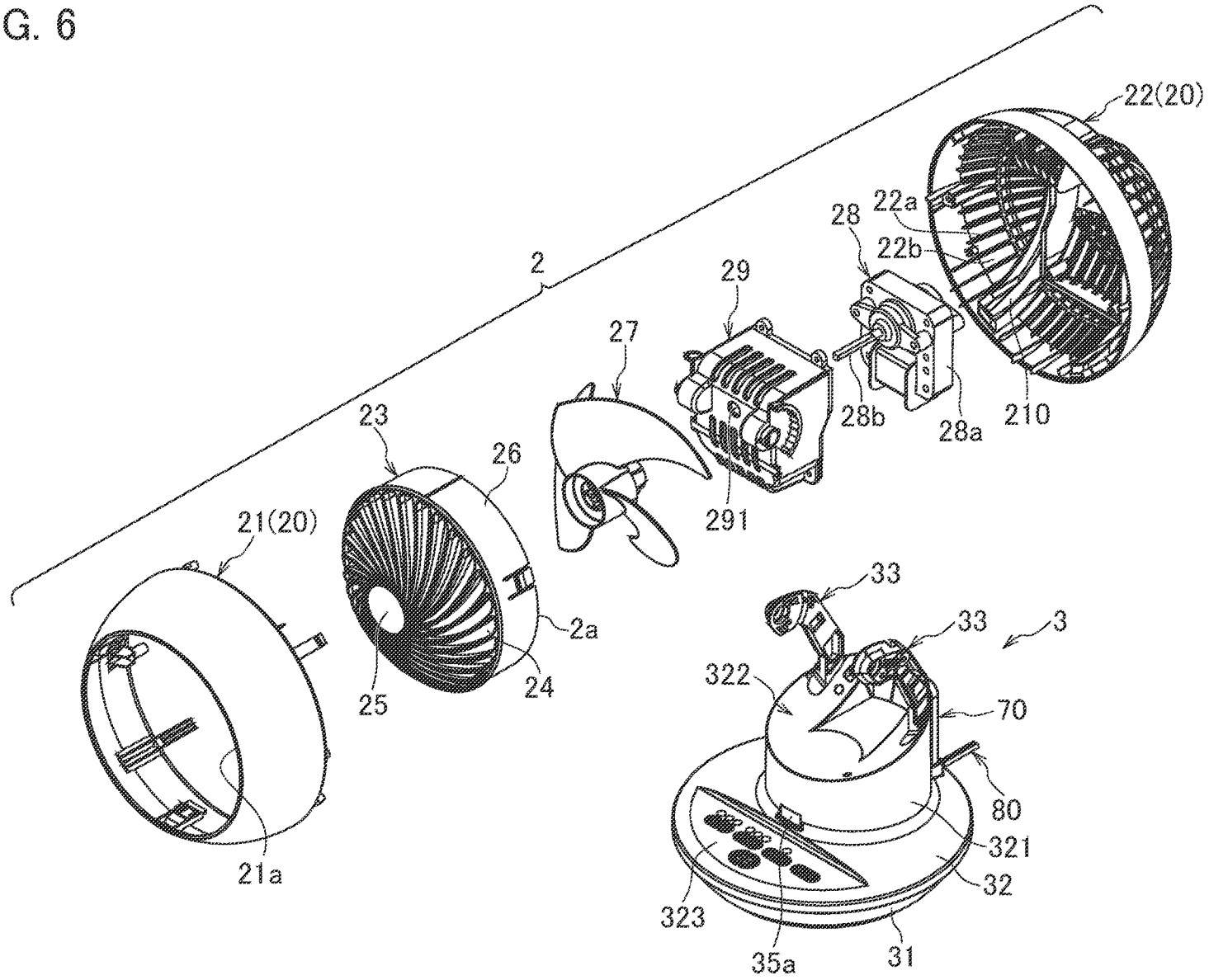
FIG. 6 It is a perspective view of the blower according to the present embodiment.

The blower unit 2 includes the cover (housing) 20 on which the slits 210 extending vertically are formed as shown in FIG. 6, and the cover (housing) 20 has the front cover 21 and the rear cover 22 that are dividable at the front-rear center position of the blower unit 2.

In addition, the blower unit 2 has the grill 23. Further, the blower unit 2 has a fan 27 for generating airflow, a motor 28 for driving the fan 27, and a motor cover 29 that is attached to the rear cover 22 in a state where it holds the motor 28.

As shown in FIG. 6, the front cover 21 is formed to have a tubular shape like a shape obtained by cutting out a front half portion of a spherical shell, and has an circular opening 21*a* that is opened toward the front. This front cover 21 can be made of synthetic plastic material such as polypropylene. And, the spherical grill 23 is snapped into the circular opening 21*a* from the rear.

The grill 23 is a front panel formed of synthetic plastic material having high impact resistance, for example. In the present embodiment, the grill 23 has plural spiral fins 24 to have a convex shape such that the plural fins 24 protrude gradually as they are directed to the center O of the spiral. According to this, when air is sent from behind of the grill 23 and the airflow (wind) passes through the grill 23 in the front-rear direction, a spiral airflow that flows forward while spiraling is generated. In the present embodiment, the grill 23 is formed such that its front face forms part of a spherical surface.

As explained above, in the present embodiment, the front cover 21 and the grill 23 form a hemisphere on the front side of the blower unit 2.

On the other hand, the rear cover 22 is formed by plural bars 22*a* to have a hemispherical shape, and a large number of air-through openings 22*b* for taking in external air are formed on almost an entire of the rear cover 22. This rear cover 22 can be also made of synthetic plastic material such as polypropylene.

Then, by coupling the front cover 21 into which the grill 23 has been snapped and the rear cover 22 with each other, the spherical shape is formed. In other words, by coupling the front cover 21 into which the grill 23 has been snapped and the rear cover 22 with each other, the spherical blower unit 2 is formed.

Then, by giving the spherical shape to the appearance of the blower unit 2, a sleek appearance can be brought, and it looks more compact because no sharp edge is formed. In addition, its cute appearance and its fashionable look can be improved.

Note that a configuration may be taken, in which the plural fins 24 are supported by a circular ring(s) that intersects each of the fins 24 in order to prevent a hand or a finger from being entered through interspaces of the plural fins 24 and to reinforce the grill 23.

Further, in the present embodiment, a hollow cylindrical airflow tunnel 26 that extends backwards is provided along an outer circumferential edge of the grill 23. This airflow tunnel 26 is a hollow cylindrical member provided on a radially outer side of the fan 27, and an inner diameter of the airflow tunnel 26 is almost identical to an inner diameter of the airflow opening 2*a*. In other words, an inner side of the grill 23 from a portion on which the airflow tunnel 26 is continuously provided is the airflow opening 2*a* of the blower unit 2 in the present embodiment. In the present embodiment, by providing the hollow cylindrical airflow tunnel 26 within the blower unit 2 as explained above, directionality and straightness of the airflow, which are specific functions of an air circulator, can be ensured.

The motor 28 drives the fan 27, and includes a motor main body 28*a* and an output shaft 28*b* protruding from the motor main body 28*a*. And, the fan 27 is attached to a distal end of the output shaft 28*b*, and the fan 27 rotates about the output shaft 28*b* when the motor 28 is driven.

In addition, the motor 28 is held by the motor cover 29. Specifically, the motor main body 28*a* is held by the motor cover 29 in a state where the output shaft 28*b* is being inserted through an insertion hole 291 of the motor cover 29. This motor cover 29 is attached to the rear cover 22 in a state where it holds the motor 28.

And, by coupling the rear cover 22 with the front cover 21 into which the grill 23 has been snapped in a state where the motor 28 and the fan 27 are attached to the rear cover 22 via the motor cover 29, the blower unit 2 within which the blower mechanism is installed is formed.

And, by applying the above-mentioned configuration as the configuration of the blower unit 2, the external air taken in through the air-through openings 22*b* of the rear cover 22 is blown from the airflow opening 2*a* while the fan 27 is rotated by driving the motor 28, so that the airflow is sent forward from the blower unit 2. Note that, since the airflow (wind) directed forward from behind flows forward as the spiral airflow when passing through the grill 23, the wind blown from the airflow opening 2*a* flows forward while generating the spiral airflow.

Further, wind holes 22*c* are formed at a portion of the rear cover 22 behind the motor in the present embodiment, and wind holes 292 are formed on the motor cover 29.

Therefore, the external air is taken in also through the wind holes 22*c* behind the motor while the motor 28 drives the fan 27, so that the volume rate of the airflow can be ensured more. Further, the airflow flowing through the wind holes 292 is also generated while the motor 28 drives the fan 27, so that a cooling effect for the motor 28 can be brought by the airflow generated by the motor 28 itself and thereby a countermeasure against the heat generation of the motor 28 can be also brought.

Support Unit

The support unit 3 is placed on an installation surface such as a floor surface, and an electrical cable 80 is attached to the support unit 3. In addition, as shown in FIG. 7, the support unit 3 includes the main body above which the blower unit 2 is positioned, and a pair of the support pillars 33 that are fixed with the main body and support the blower unit 2 within the cover (housing) 20.

It is preferable that a size of the main body of the support unit 3 in a plan view is almost identical to or not larger than a size of the blower unit 2 in the plan view. According to this, as shown in FIG. 4, a size of the blower 1 in the plan view is made almost identical to the size of the blower unit 2 in the plan view, and thereby an entire of the blower 1 can be restricted from becoming too large. Note that, if the size of the support unit 3 in the plan view is made almost identical to the size of the blower unit 2 in the plan view, the blower 1 can be down-sized while restricting the blower 1 from being tumbled down. In other words, it becomes possible to place the blower 1 more stably while making the blower 1 down-sized.

In addition, as shown in FIG. 8, an accommodation chamber 333 is formed in the support pillar(s) 33, and a push pin 41 is accommodated within the accommodation chamber 333 while it is inserted into a coil spring 42. And, the push pin 41 and the coil spring 42 are restricted from dropping off from the accommodation chamber 333 by closing the accommodation chamber 333 within which the push pin 41 and the coil spring 42 is accommodated by an drop restriction cover 34.

On the other hand, as shown in FIG. 9, the main body of the support unit 3 has a base lower portion 31 formed to have a circular shape in the plan view, and a base upper portion 32 capable of being coupled with the base lower portion 31. With respect to the base lower portion 31 and the base upper portion 32, their covers that form their outer surfaces can be formed of synthetic plastic material such as polypropylene.

And, a void space is formed in the main body of the support unit 3, and a circuit board 35, a lateral swing mechanism 60 and so on are accommodated in this void space.

In addition, a single-foot shaped support post 321 is vertically raised posteriorly from the center of a cover of the base upper portion 32, and a control panel 323 is disposed anteriorly from the support post 321 on the cover of the base upper portion 32. Further, the blower unit 2 is disposed above an upper face 322 of the support post 321 in a state where the clearance (predetermined clearance D2 in the present embodiment) is formed between it and the upper face 322.

Therefore, when determining the height of the support post 321 and an eccentric position of the support post 321 from the center (the center of the base upper portion in the plan view), it is preferable to form an enough space between the blower unit 2 and the control panel 323 not to inhibit operations of the control panel 323 by a use or the like.

A power button for changing on/off the power source, an airflow volume button for adjusting the volume rate of the airflow, a swing button for changing on/off of the lateral swinging and so on are provided on the control panel 323, for example.

In addition, openings 322*b* that are opened upward are formed on both sides on the upper face 322 of the support post 321 in the width direction, respectively, and the support pillars 33 are held by the main body of the support unit 3 by inserting distal ends (lower ends) of the support pillars 33 into the openings 322*b*, respectively. In the present embodiment, the openings 322*b* are formed on a rear side of the upper face 322 of the support post 321. In other words, the support pillars 33 are disposed closer to the rear end of the support unit 3 in the present embodiment.

Further, in the present embodiment, the blower 1 is provided with a remote control device 70 for changing on/off of the power source and so on, and a remote control device placement portion 324 on which the remote control device 70 is placed is formed at a rear-side lower end of the support post 321 (see FIG. 5). Note that a remote control receiver 35*a* for receiving signals from the remote control device 70 is implemented on the circuit board 35, and this remote control receiver 35*a* is exposed to the front at a front-side lower end of the support post 321.

Vertical Swing Mechanism

Figure 10:
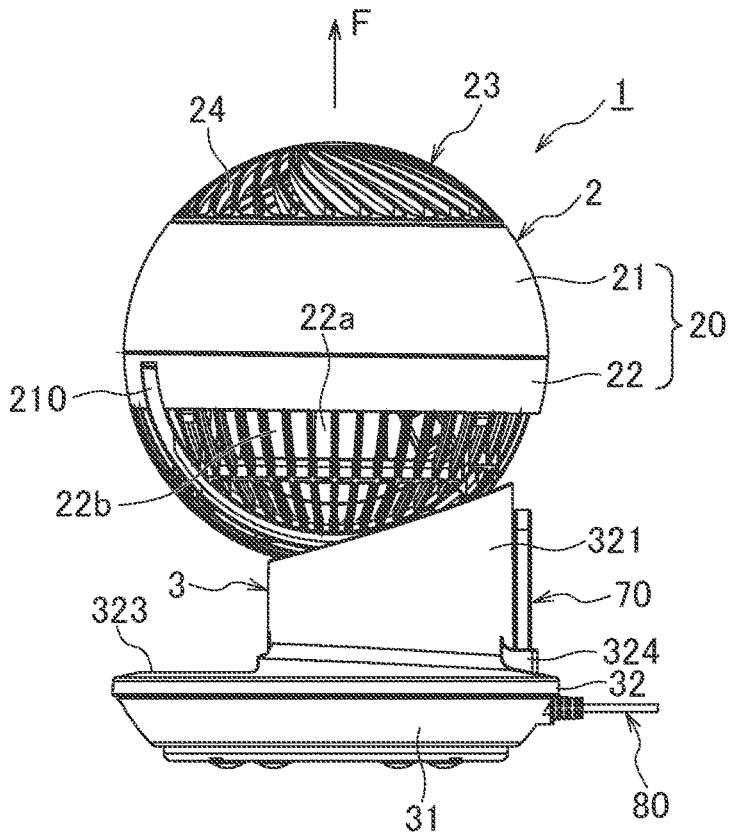
FIG. 10 It is a right side view showing a maximum upward swinging state of the blower according to the present embodiment.
Figure 11:
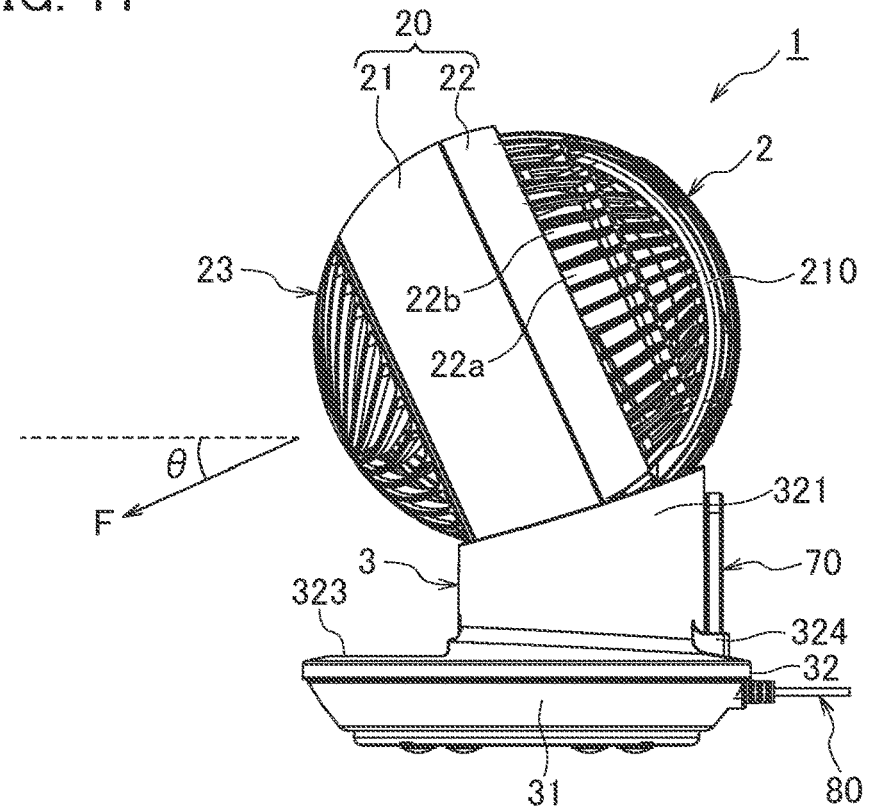
FIG. 11 It is a right side view showing a maximum downward swinging state of the blower according to the present embodiment.
Figure 12:
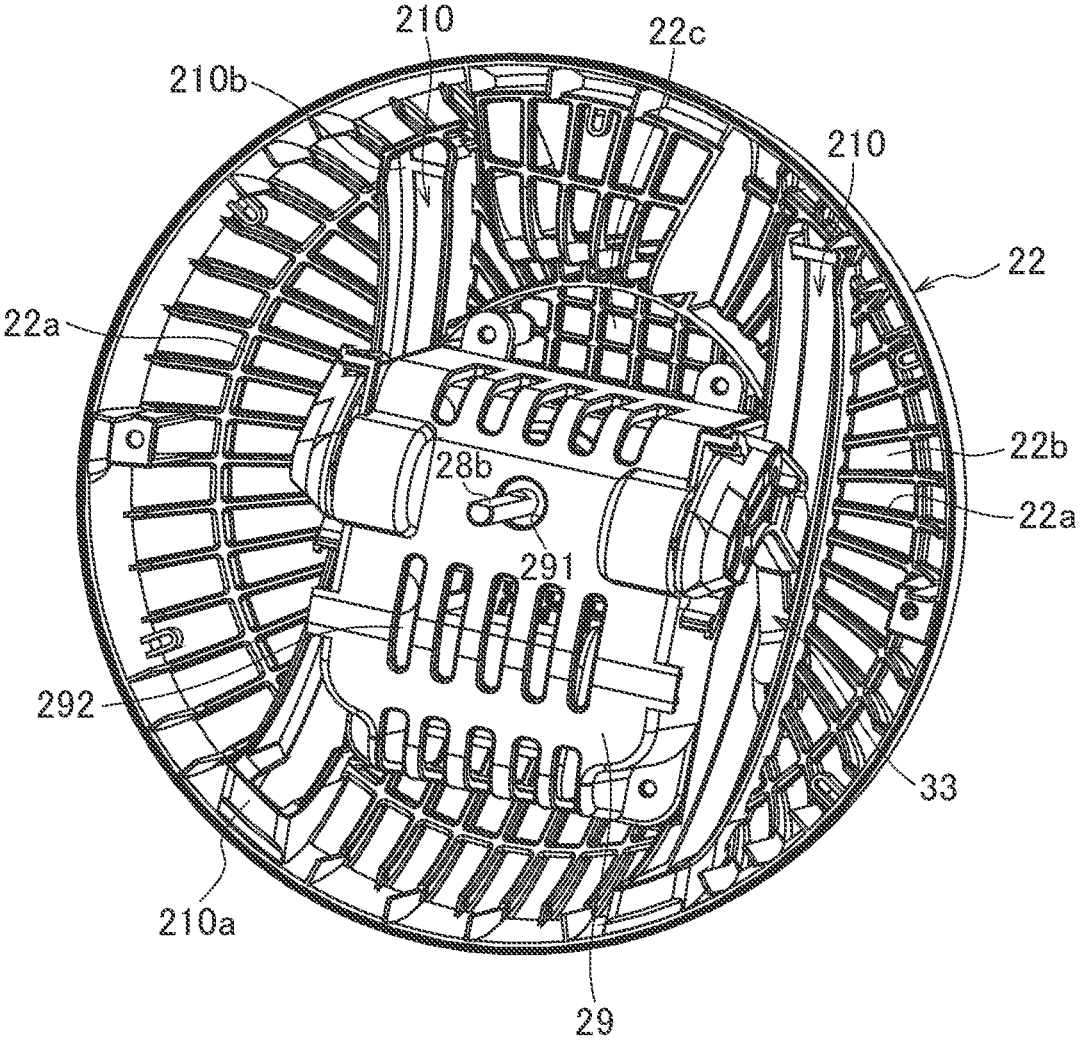
FIG. 12 It is a perspective view showing an insertion state of the support pillars through the slits in the blower according to the present embodiment.
Figure 13:
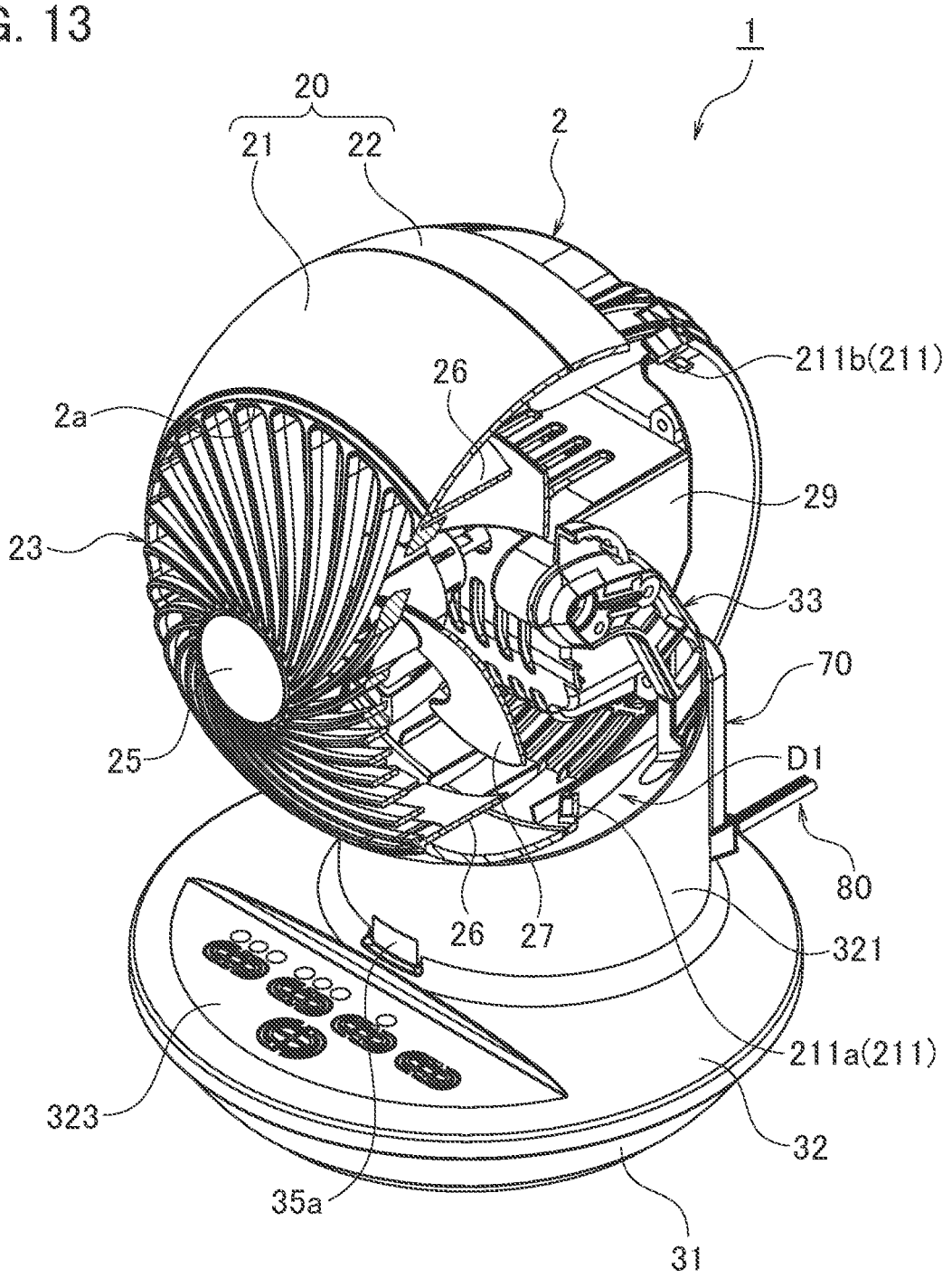
FIG. 13 It is a partially cross-sectioned perspective view showing the horizontally directed state of the blower according to the present embodiment.
Figure 14:
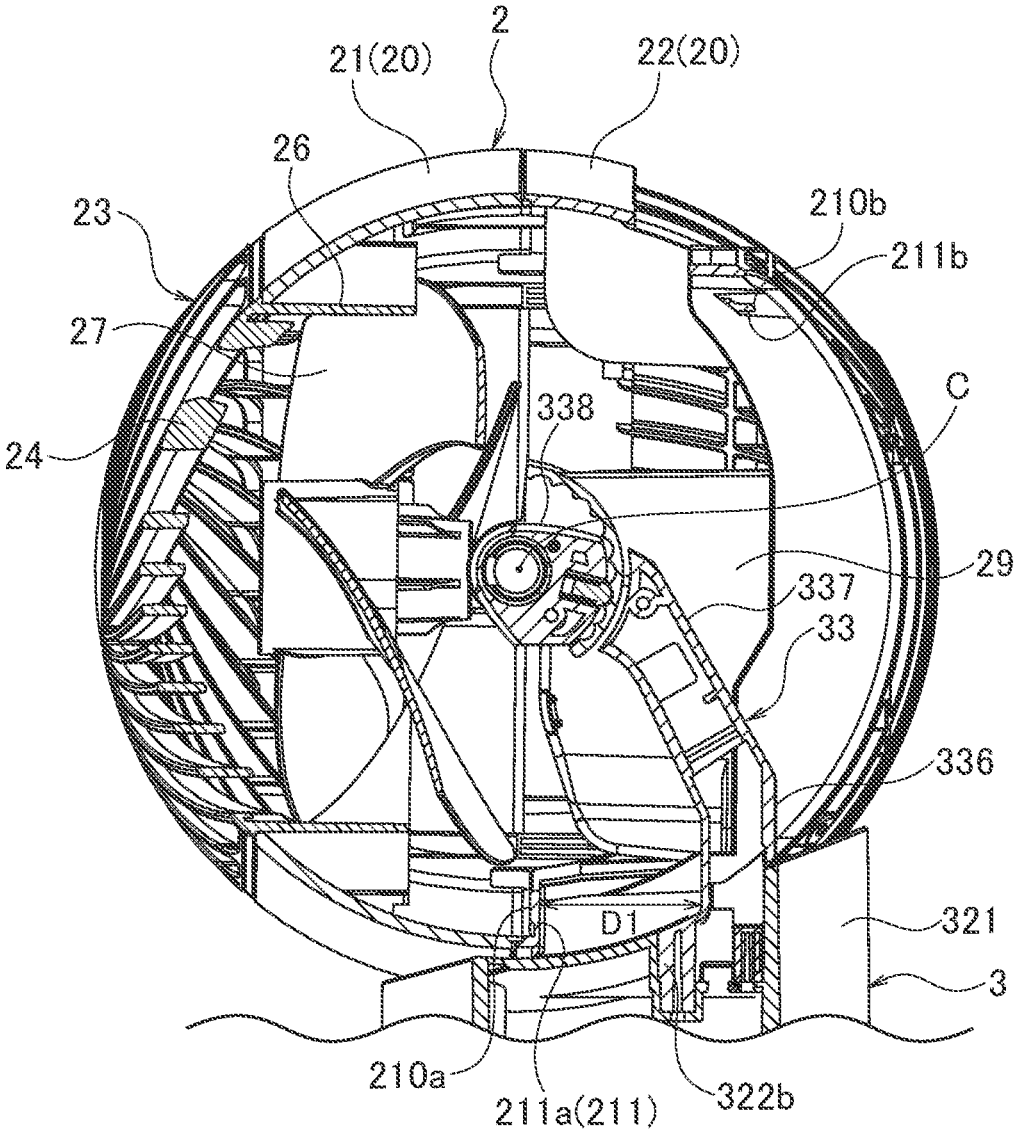
FIG. 14 It is a partially cross-sectioned right side view showing the horizontally directed state of the blower according to the present embodiment.
Figure 15:
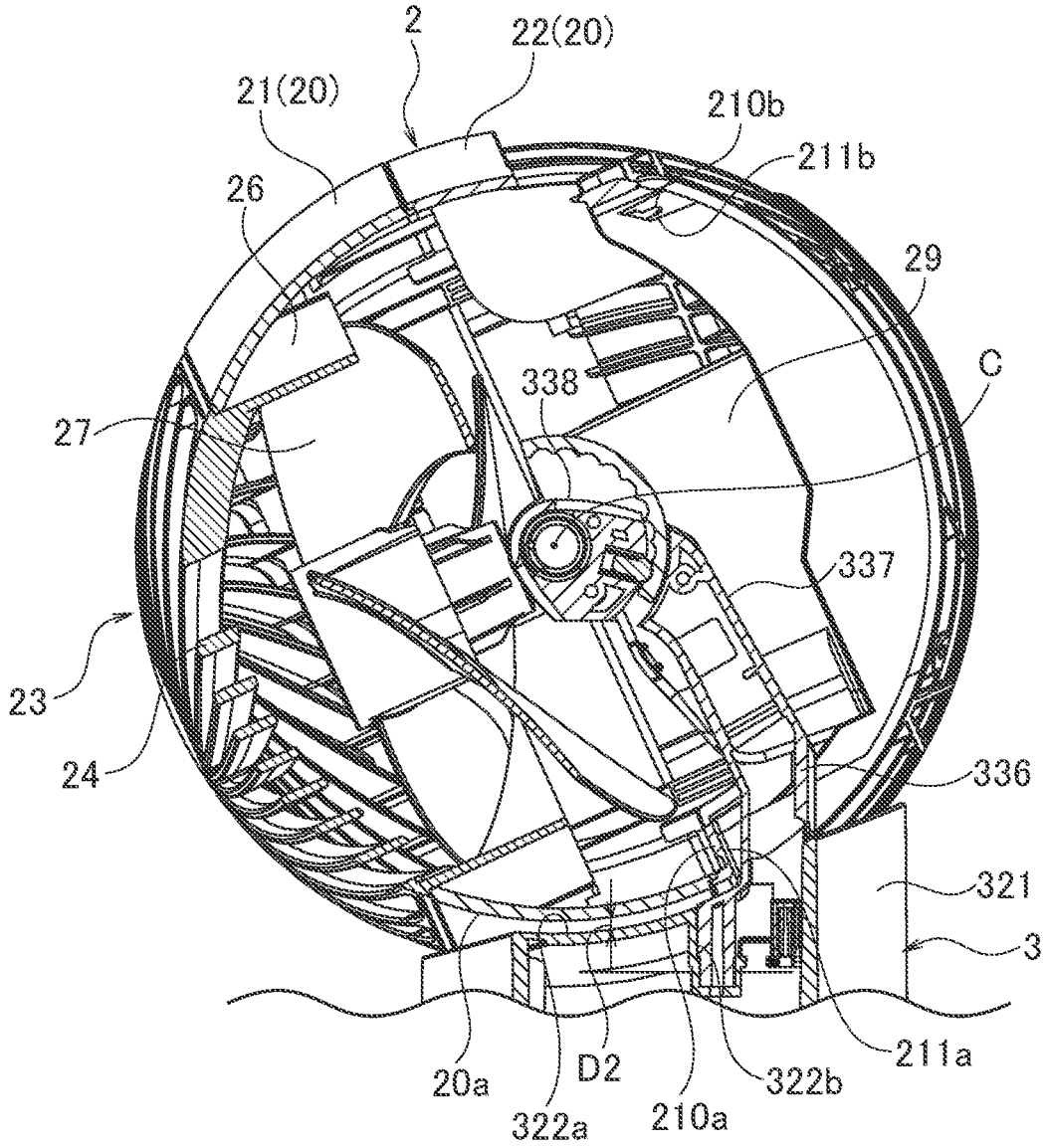
FIG. 15 It is a partially cross-sectioned right side view showing the maximum downward swinging state of the blower according to the present embodiment.
Figure 16:
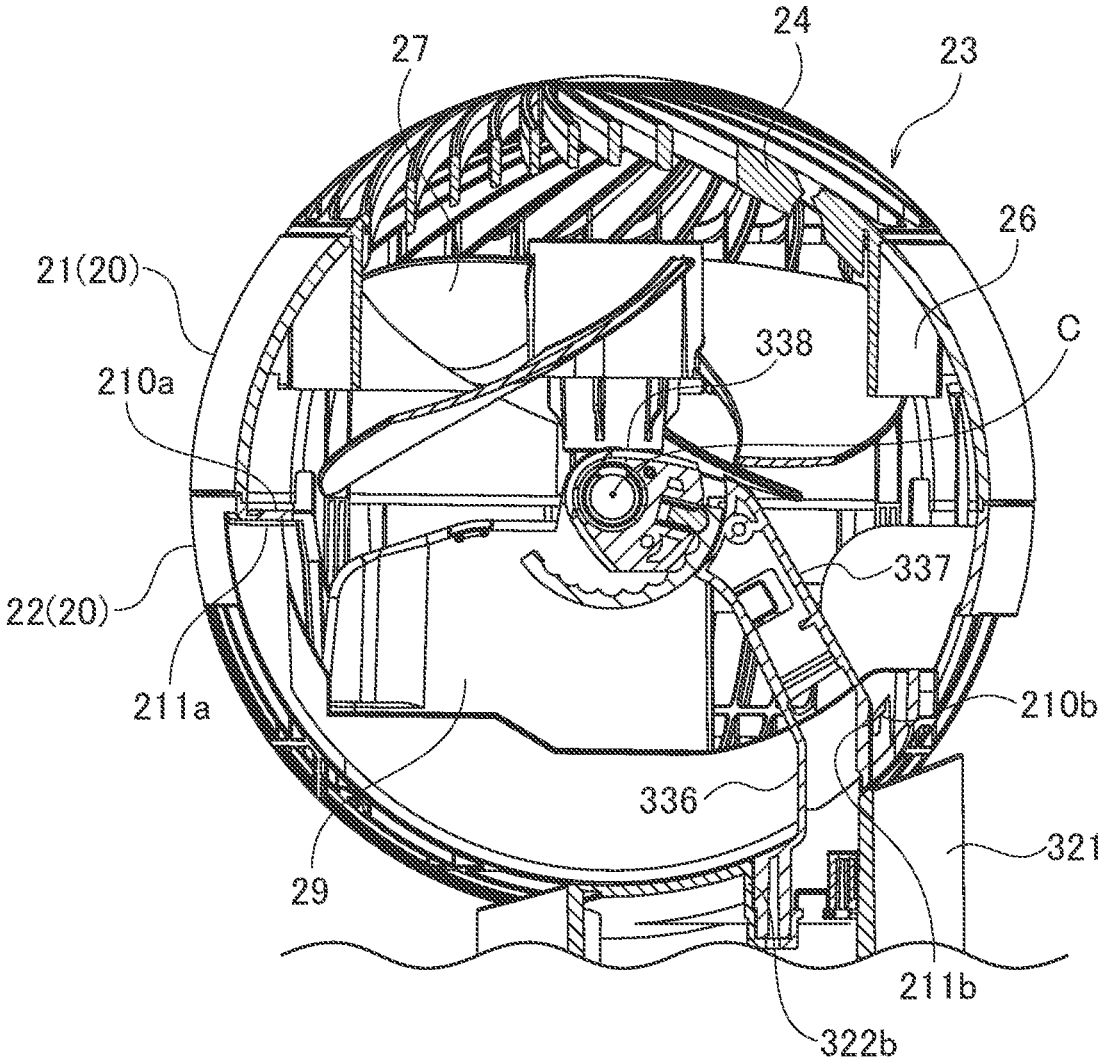
FIG. 16 It is a partially cross-sectioned right side view showing the maximum upward swinging state of the blower according to the present embodiment.
Figure 17:
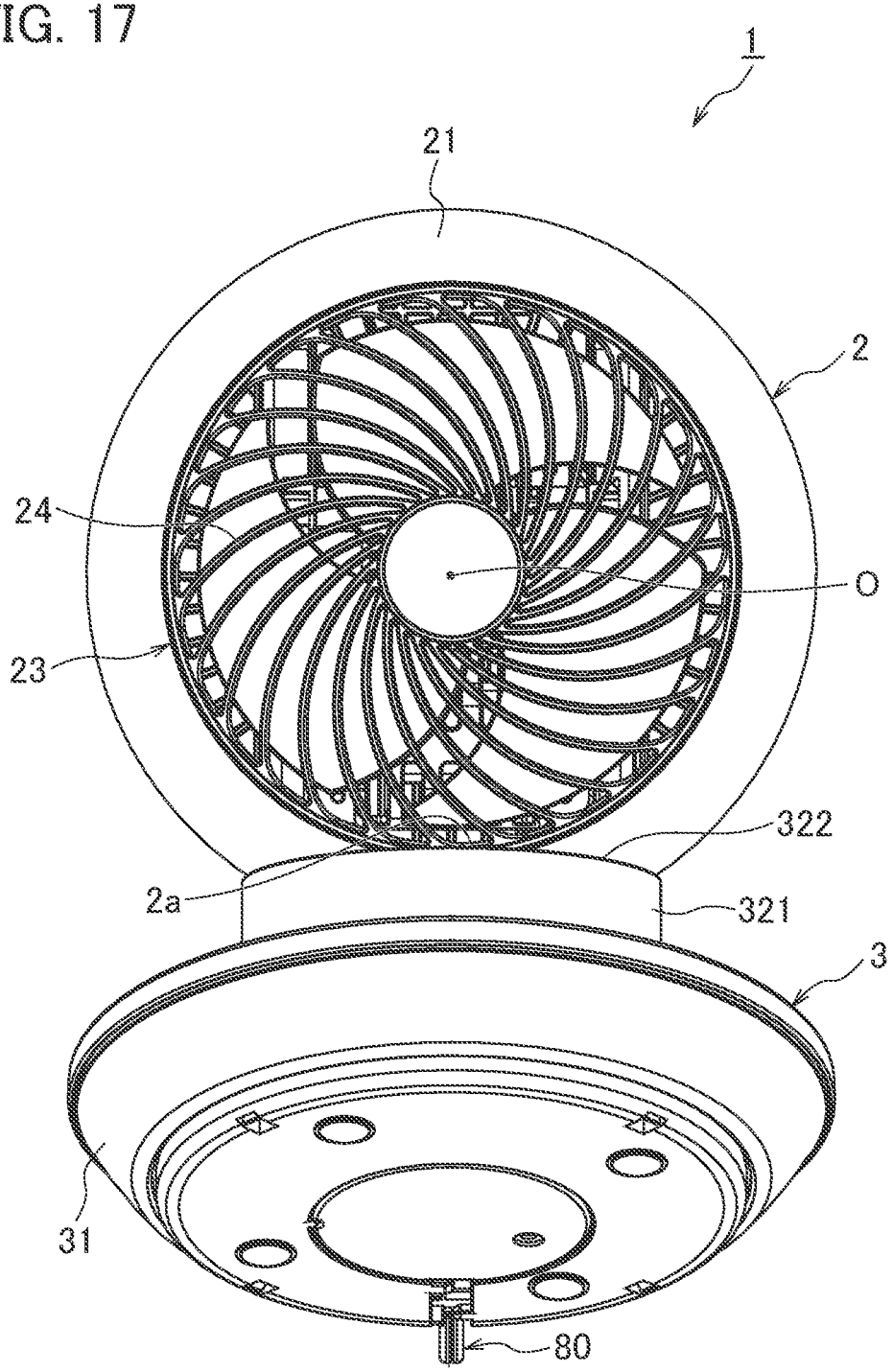
FIG. 17 It is a view showing the maximum downward swinging state of the blower according to the present embodiment when being viewed along an airflow direction.

In the present embodiment, the blower unit 2 is supported to be swingable vertically by the support unit 3. Hereinafter, a vertical swing mechanism of the blower unit 2 will be explained with reference to FIG. 10 to FIG. 17. Note that FIG. 10 is a right side view showing a maximum upward swinging state of the blower, FIG. 11 is a right side view showing a maximum downward swinging state of the blower, and FIG. 12 is a perspective view showing an insertion state of the support pillars through the slits in the blower. In addition, FIG. 13 is a partially cross-sectioned perspective view showing a horizontally directed state of the blower, and FIG. 14 is a partially cross-sectioned right side view showing the horizontally directed state of the blower. Further, FIG. 15 is a partially cross-sectioned right side view showing the maximum downward swinging state of the blower, FIG. 16 is a partially cross-sectioned right side view showing the maximum upward swinging state of the blower, and FIG. 17 is a view showing the maximum downward swinging state of the blower when being viewed along an airflow direction.

In the blower 1 according to the present embodiment, the blower unit 2 can swing within a rage from the maximum upward swinging state shown in FIG. 10 to the maximum downward swinging state shown in FIG. 11. In other words, the blower unit 2 can be swung such that the airflow direction F can be directed not only upward above the horizontal direction but also downward below it in the blower 1 according to the present embodiment. Specifically, the blower unit 2 can be swung in a range within which an angle θ defined between the airflow direction F and the horizontal direction takes from −25° to +90°

Here, as shown in FIG. 12, the support pillars 33 are pivotally coupled with the motor cover 29 fixed on the rear cover 22 in a state where they are inserted through the slits 210 formed on the rear cover 22 so as to extend in an up-down direction.

Specifically, tubular axial portions 293 are formed on both sides of the motor cover 29 in the width direction, respectively, so as to protrude outward in the width direction, and insertion holes 332 into which the axial portions 293 are inserted are formed at ends of the support pillars 33 which are positioned within the cover (housing) 20, respectively.

And, by inserting the axial portions 293 formed on both sides of the motor cover 29 in the width direction into the insertion holes 332 of the support pillars 33, respectively, the motor cover 29 is held to be swingable vertically in a pincer state where it is held by the pair of the support pillars 33.

In addition, lower ends (ends that are positioned outside the housing) of the support pillars 33 are inserted into the openings 322*b* formed on the upper face 322 of the support post 321, so that they inserted through the slits 210 are held by the main body of the support unit 3.

As explained above, by supporting the motor cover 29 to be swingable vertically by the pair of the support pillars 33 in a state where the lower ends of the support pillars 33 are held by the main body of the support unit 3, the motor cover 29 is configured to be swingable with respect to the support unit 3 (the main body and the support pillars 33).

Here, the rear cover 22 on which the motor cover 29 is fixed, the motor 28 fixed with the rear cover 22 via the motor cover 29 and the fan 27, the front cover 21 coupled with the rear cover 22, and the grill 23 and the airflow tunnel 26 that are snapped into the front cover 21 swing along with swinging of the motor cover 29.

In other words, by swinging the motor cover 29 pivotally coupled with the pair of the support pillars 33 with respect to the support unit 3 (the main body and the support pillars 33), the entire of the blower unit 2 swings with respect to the support unit 3 (the main body and the support pillars 33).

Here, the blower unit 2 swings from a state where the support pillars 33 are positioned at a side of the lower ends 210*a* of the slits 210 to a state where they are positioned at a side of upper ends 210*b* of the slits 210 with respect to the support unit 3 (the main body and the support pillars 33).

Here, the blower unit 2 swings from a state where the pillars 33 are positioned at a side of the lower ends 210*a* of the slits 210 to a state where they are positioned at a side of upper ends 210*b* of the slits 210 with respect to the support unit 3 (the main body and the pillars 33).

Here in the present embodiment, the blower unit 2 is configured to be swingable such that the airflow direction F of the blower unit 2 can be directed toward a lower side below the horizontal direction.

Specifically, as shown in FIG. 13 and FIG. 14, the distance D1 is formed between the lower ends 210*a* of the slits 210 and the support pillars 33 in the horizontally directed state where the airflow direction F of the blower unit 2 is in line with the horizontal direction.

As explained above, the support pillars 33 are disposed closer to the rear end of the support unit 3 in the present embodiment. Specifically, the support pillar(s) 33 includes, in a state where it is held by the support unit 3, a vertical portion 336 raised upward from the opening 322*b*, an inclined portion 337 extended from an upper end of the vertical portion 336 obliquely forward and upward, and a pivotally coupling portion 338 extended from an end of the inclined portion 337 and coupled with the axial portion 293. Note that the above-explained insertion hole 332 is formed on the pivotally coupling portion 338.

And, the slits 210 are located in the middle of the vertical portions 336 in a state where the support pillars 33 are held at positons closer to the rear ends of the support unit 3.

In addition, the cover (housing) 20 is configured to be dividable into the front cover 21 and the rear cover 22 at the front-rear center position of the blower unit 2 in the horizontally directed state, and the slit(s) 210 is extended to a position closer to a lower end edge of the rear cover 22 in the horizontally directed state. In other words, the lower end 210*a* of the slit(s) 210 positions at a position closer to a front-rear center position of the support unit 3.

According to this, the distance D1 is formed between a lower end face 211*a* that defines the lower end 210*a* of the slit(s) 210 and a front face of the support pillar(s) 33 in the horizontally directed state of the blower 1.

And, by forming the distance D1 between the lower end face 211*a* and the front face of the support pillar(s) 33 in the horizontally directed state, the blower unit 2 can be swung downward to a position at which the front face of the support pillar(s) 33 contacts with the lower end face 211*a* (see FIG. 15). In other words, the blower unit 2 is made swingable such that the airflow direction F of the blower unit 2 can be directed toward a lower side below the horizontal direction.

Further, the slit(s) 210 is extended to a position closer to an upper end edge of the rear cover 22 in the horizontally directed state. That is to say, the slit(s) 210 is formed on the rear cover 22 from its lower face to its upper face through its back face. In other words, the slit(s) 210 is formed from the lower face to the upper face through the back face of the rear cover 22.

Therefore, the blower unit 2 is made swingable upward to a position where a rear face of the support pillar(s) 33 contacts with the upper end face 211*b* defining the upper end 210*b* of the slit(s) 210 (see FIG. 16).

As explained above, in the present embodiment, the blower unit 2 is configured to be swingable within a range from a state where the support pillars 33 are positioned on a side of the upper ends 210*b* of the slits 210 to a state where they are positioned on a side of the lower ends 210*a* thereof.

Note that the state where the blower unit 2 is swung to the position where the front faces of the support pillars 33 contact with the lower end faces 211*a* of the slits 210 (the state shown in FIG. 15) is the maximum downward swinging state of the blower 1 (the state where the blower unit 2 is swung to the lower limit within its swingable range). In the present embodiment, the state where the angle θ between the airflow direction F and the horizontal direction takes −25° is the maximum downward swinging state as explained above.

In addition, the state where the blower unit 2 is swung to the position where the rear faces of the support pillars 33 contact with the upper end faces 211*b* of the slits 210 (the state shown in FIG. 16) is the maximum upward swinging state of the blower 1 (the state where the blower unit 2 is swung to the upper limit within its swingable range). In the present embodiment, the state where the angle θ between the airflow direction F and the horizontal direction takes +90° is the maximum upward swinging state as explained above.

Further, in the present embodiment, the pivotally coupling portion 338 is formed at the end of the inclined portion 337 of the support pillar(s) 33, and this pivotally coupling portion 338 represents the swing axis C of the blower unit 2 (see FIG. 14 to FIG. 16).

Furthermore, in the present embodiment, the swing axis C of the blower unit 2 is coincident with the center of the spherical blower unit 2 in a side view (a state viewed along a direction of the swing axis).

By making the swing axis C of the blower unit 2 coincident with the center of the blower unit 2 as explained above, the outer surface of the cover (housing) 20 represents the spherical surface 20*a* with its center on the swing axis C of the blower unit 2. In other words, the cover (housing) 20 has the spherical surface 20*a* with its center on the swing axis C of the blower unit 2 in this embodiment.

Further, in a state where the blower unit 2 is supported by the support unit 3, the concave spherical surface 322*a* is formed on the upper face 322 of the support post 321 that faces to the spherical surface 20*a*. This concave spherical surface 322*a* is part of a spherical plane that is concentric with respect to the spherical surface 20*a*.

By forming the spherical surface 20*a* and the concave spherical surface 322*a* on the blower unit 2 and the support unit 3, respectively, as explained above, the concave spherical surface 322*a* faces to the spherical surface 20*a* to form the predetermined clearance D2 therebetween. Further, they are configured such that the clearance D2 between the spherical surface 20*a* and the concave spherical surface 322*a* of the support unit 3 doesn't enlarge while swinging the blower unit 2.

According to this, the blower unit 2 and the support unit 3 can be restricted from contacting with each other while swinging the blower unit 2. In addition, a silhouette of the blower 1 (an outline shape of the blower 1 in the side view) hardly changes even when the blower unit 2 is swung.

Further, by restricting the clearance D2 between the spherical surface 20*a* and the concave spherical surface 322*a* of the support unit 3 from enlarging, it is restricted that an obstacle or the like is tucked in the clearance between the blower unit 2 and the support unit 3 while swinging the blower unit 2, and thereby safeness can be improved.

Note that it is enough as long as the spherical surface 20*a* is formed on a portion facing to the concave spherical surface 322*a* while the blower unit 2 is swung within its swingable range, and it is not needed that an entire of the outer surface of the blower unit 2 is made as the spherical surface 20*a*.

Further, as shown in FIG. 17, the airflow opening 2*a* of the blower unit 2 is not closed by the support unit 3 in the maximum downward swinging state where the blower unit 2 is swung to the lower limit within the swingable range in the present embodiment. In other words, it is configured that a lower end of the circular airflow opening 2*a* positions at an equivalent position to a front-side upper end of the support post 321 or positions above the front-side upper end of the support post 321 in the state viewed along the airflow direction F of the blower 1.

According to this, the airflow blown through the airflow opening 2*a* can be restricted from colliding with the support unit 3 even in the maximum downward swinging state of the blower 1. In other words, the airflow blown through the airflow opening 2*a* can be restricted from being dispersed by the support unit 3.

Angle Adjustment Mechanism

Figure 18:
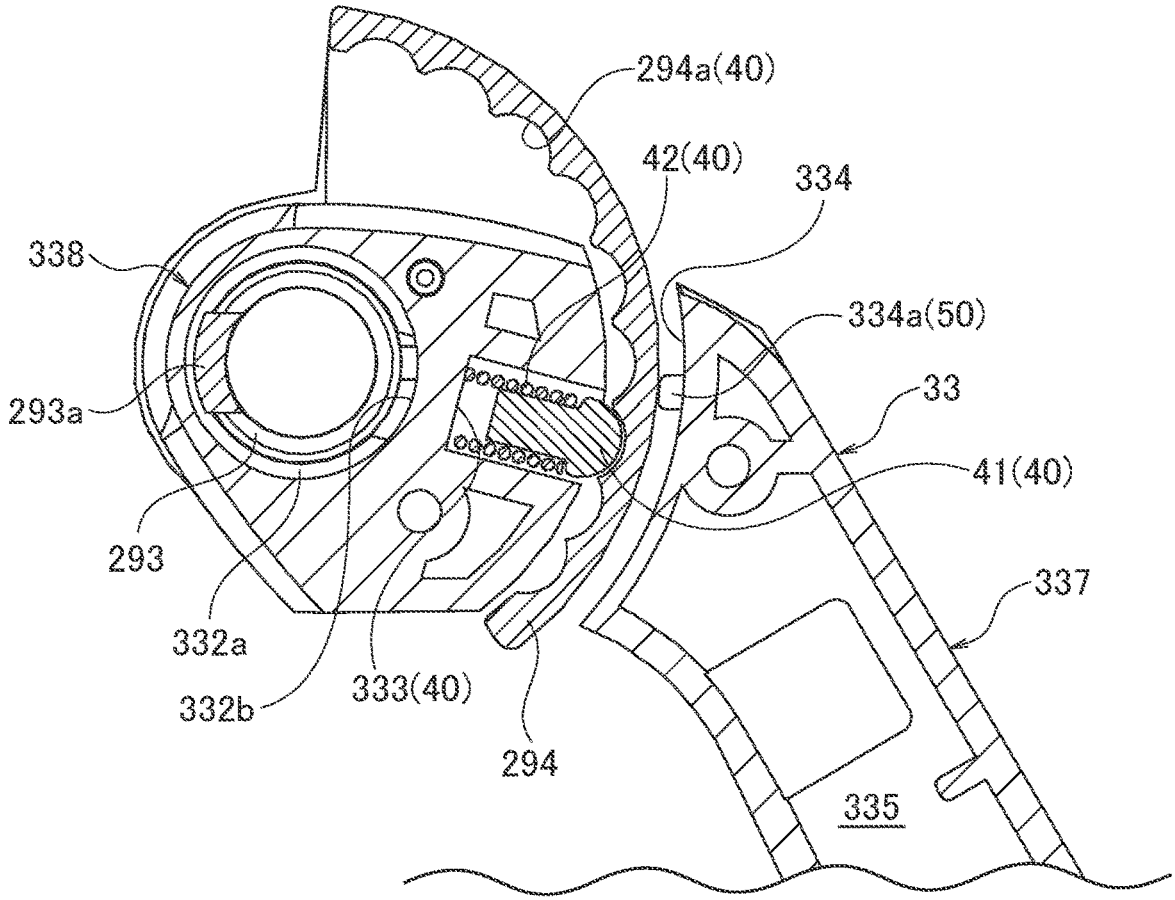
FIG. 18 It is a cross-sectional view showing an angle adjustment mechanism of the blower according to the present embodiment.

In addition, the blower 1 includes an angle adjustment mechanism 40 in the present embodiment, and thereby the blower unit 2 can be held at predetermined angles in a stepwise manner when swinging the blower unit 2 within the swingable range. Hereinafter, the angle adjustment mechanism 40 according to the present embodiment will be explained by using FIG. 18. Note that FIG. 18 is a cross-sectional view showing the angle adjustment mechanism of the blower.

The angle adjustment mechanism 40 according to the present embodiment includes the push pin 41 that is pressed onto the motor cover 29 to restrict the motor cover 29 from swinging, and the coil spring 42 into which the push pin 41 is inserted and that urges the push pin 41 toward the motor cover 29.

The push pin 41 and the coil spring 42 are accommodated in the accommodation chamber 333 of the support pillar(s) 33.

In addition, arc-shaped lock portions 294 with its center on the swing axis C are formed on both sides of the motor cover 29 in the width direction, respectively, so as to protrude outward in the width direction, and plural concave notches 294*a* are formed at predetermined intervals along the swing direction on this lock portion(s) 294 on its side of the swing axis C. These plural concave notches 294*a* are associated with the swingable range (−25° to +90°) of vertical swinging of the blower unit 2.

And, the distal end of the push pin(s) 41 accommodated in the accommodation chamber 333 is contacted with the concave notch 294*a* in a state where the support pillars 33 hold the motor cover 29. Here, the coil spring 42 accommodated in the accommodation chamber 333 in a state where it is compressed to be made shorter than its free length, and thereby the push pin 41 is urged toward the concave notch 294*a* by the coil spring 42.

According to this, the push pin(s) 41 shifts its position along the concave notches 294*a* in a clicking manner while a user swings the blower unit 2 vertically by his/her hand. Then, the concave notch 294*a* is pressed by the push pin(s) 41 when swinging of the blower unit 2 is stopped in a state where the push pin 41 contacts with one of the plural concave notches 294*a*, and thereby the push pin(s) 41 is locked with the concave notch 294*a* with an adequate strength.

As explained above, the angle adjustment mechanism 40 according to the present embodiment is configured of the push pins 41, the coil springs 42, the accommodation chambers 333 each of which accommodates the push pin 41 and the coil spring 42, and the plural concave notches 294*a* that are pressed by the push pins 41. And, any one of the plural concave notches 294*a* is locked by the push pin(s) 41.

By providing the angle adjustment mechanism 40 explained above, the angle of the blower unit 2 (angle of the airflow direction F with respect to the horizontal direction) can be changed manually in a stepwise manner.

Note that a slit 334 is formed at a joint portion between the inclined portion 337 and the pivotally coupling portion 338 in order to restrict the lock portion 294 from contacting with the support pillar 33 while swinging the motor cover 29 with respect to the support unit 3. This slit 334 is also formed to have an arc shape with its center on the swing axis C.

Reinforcing Structure for Slit

In addition, reduction of the strength due to the formation of the slit(s) 210 from the lower face to the upper face of the rear cover 22 is restricted in the present embodiment. Hereinafter, a reinforcing structure for the slit(s) 210 according to the present embodiment will be explained by using FIG. 19 to FIG. 21. Note that FIG. 19 is a back view showing the rear cover of the blower, FIG. 20 is a perspective view showing the support pillar of the blower, and FIG. 21 is a cross-sectional view showing the insertion state of the support pillar through the slit in the blower.

Figure 19:
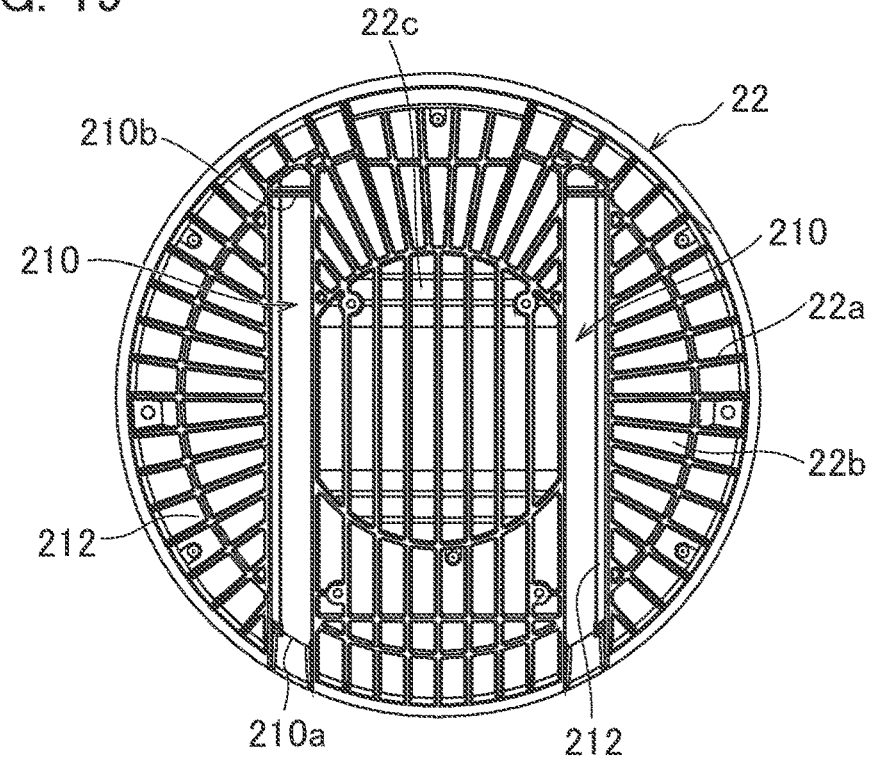
FIG. 19 It is a back view showing a rear cover of the blower according to the present embodiment.
Figure 20:
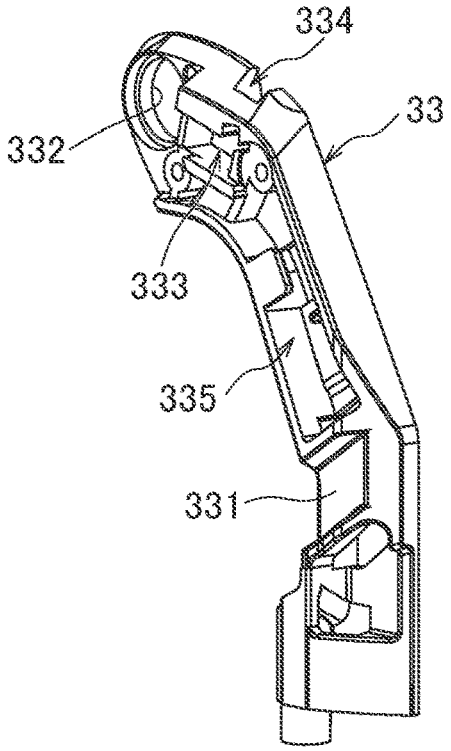
FIG. 20 It is a perspective view showing the support pillar of the blower according to the present embodiment.

In the present embodiment, as shown in FIG. 19, the slits 210 in a pair are formed at both sides, in the width direction, of the rear cover 22 formed by jointing the plural bars 22*a*, respectively, so as to extend in the up-down direction. Further, each of the slits 210 is formed from the lower face to the upper face of the rear cover 22 in the present embodiment.

Here, the strength of the rear cover 22 may be reduced by merely forming the slits 210 from the lower face to the upper face of the rear cover 22, and thereby it would be concerned that the cover (housing) 20 would deforms when swinging the blower unit 2.

Figure 21:
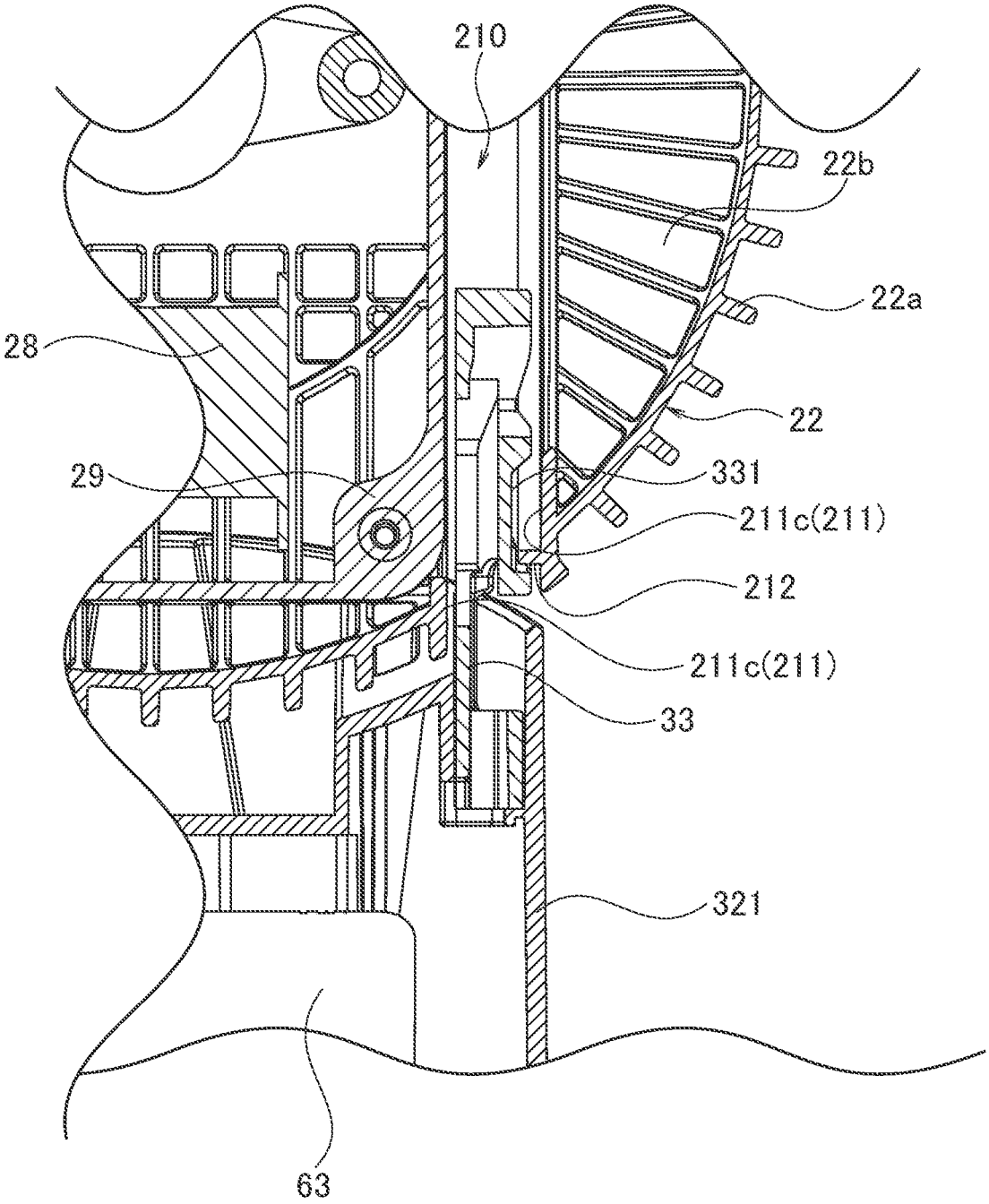
FIG. 21 It is a cross-sectional view showing the insertion state of the support pillar through the slit in the blower according to the present embodiment.

Therefore, as shown in FIG. 19 and FIG. 21, the rib 212 protruding in the width direction of the slit(s) 210 is formed on the inner face 211*c* defining the width of the slit 210 among inner faces 211 defining the slit 210 in the present embodiment. In the present embodiment, the rib 212 is formed in an almost entire range of the inner face 211*c*, which defines the width of the slit 210, from its lower end to its upper end.

By providing the rib 212 as explained above, strength of a circumferential edge portion of the slit(s) 210 whose strength becomes especially weak in the rear cover 22 can be improved, and thereby the cover (housing) 20 can be restricted from deforming when swinging the blower unit 2. Note that the inner faces 211 that define the slit(s) 210 include the lower end face 211*a*, the upper end face 211*b* and the inner faces 211*c*.

In addition, a notch 331 is formed on the support pillar(s) 33 at its portion associated with the rib 212 in the present embodiment.

By forming the notch 331 on the support pillar 33 at its portion associated with the rib 212, the support pillar 33 that has a relatively large thickness can be shifted within the slit 210 without contacting with the rib 212.

Therefore, the rear cover 22 can be reinforced while the strength of the support pillars 33 can be restricted from reducing.

In addition, a lower end of the notch 331 is positioned below the rib 212 while swinging the blower unit 2. Specifically, as shown in FIG. 21, a lower inner face of the notch 331 is made almost parallel to the rib 212. According to this, when an excessive force is applied to the cover (housing) 20, the ribs 212 contact with the lower ends of the notches 331, and thereby relative displacement between the cover (housing) 20 and the support pillars 33 can be restricted more surely.

Pivotally Coupling Mechanism

Figure 22:
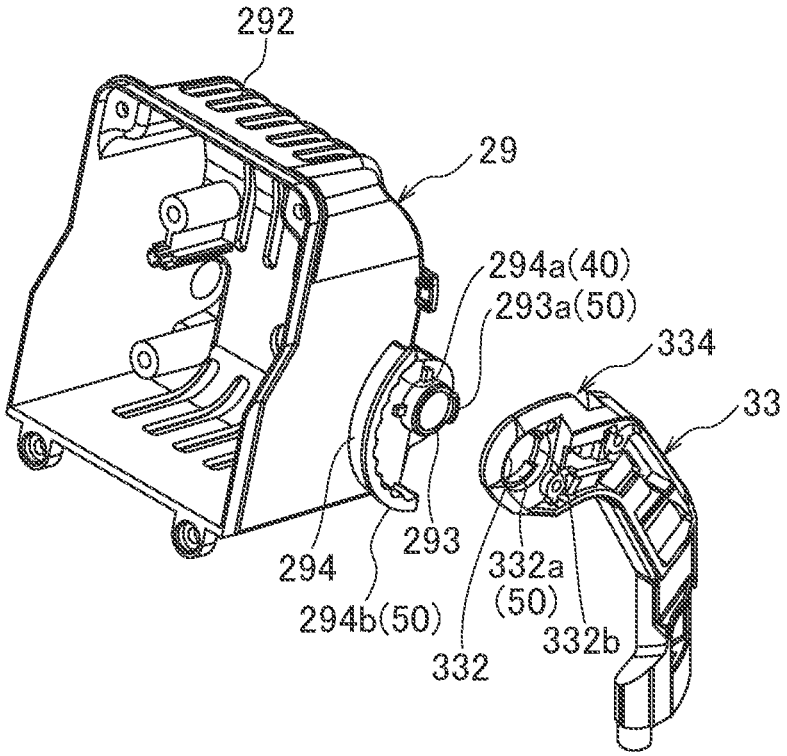
FIG. 22 It is a perspective view showing a state before an axial portion of a motor cover is inserted into an insertion hole of the support pillar in the blower according to the present embodiment.
Figure 23:
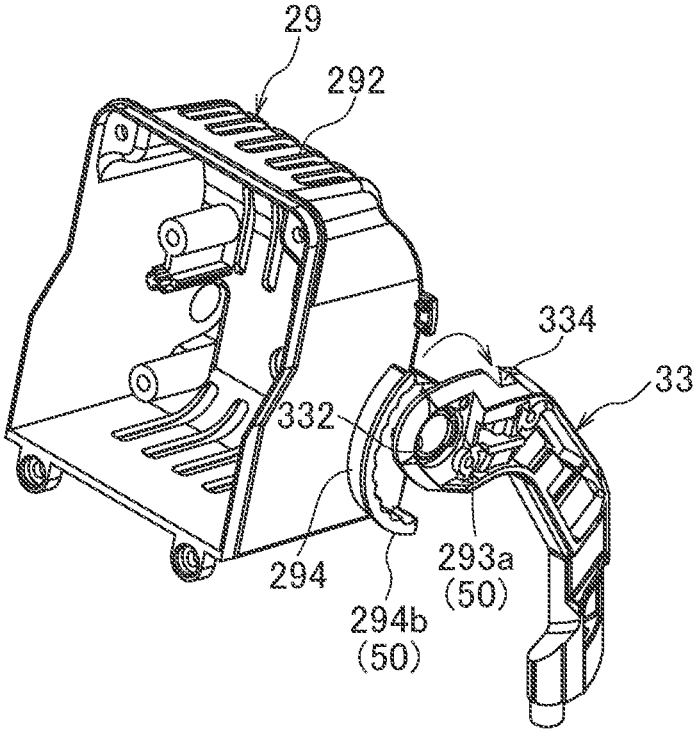
FIG. 23 It is a perspective view showing a state after the axial portion of the motor cover is inserted into the insertion hole of the support pillar in the blower according to the present embodiment.
Figure 24:
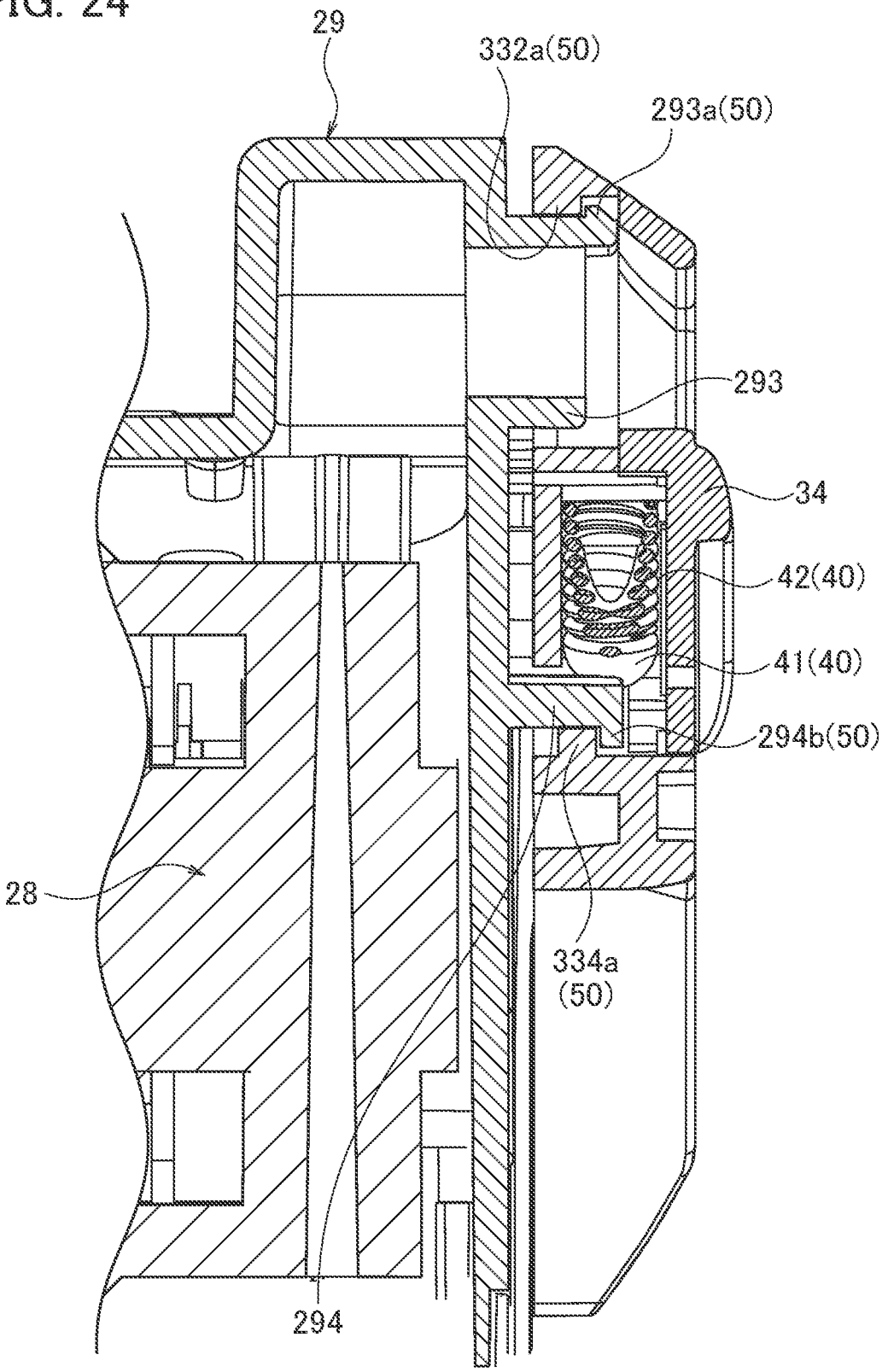
FIG. 24 It is a cross-sectional view showing a pivotally coupling mechanism of the blower according to the present embodiment.

In addition, the blower 1 includes the pivotally coupling mechanism 50 in the present embodiment in order to restrict the support pillars 33 from being released from the blower unit 2 while swinging the blower unit 2. Hereinafter, the pivotally coupling mechanism 50 according to the present embodiment will be explained by using FIG. 22 to FIG. 24. Note that FIG. 22 is a perspective view showing a state before the axial portion of the motor cover is inserted into the insertion hole of the support pillar in the blower, and FIG. 23 is a perspective view showing a state after the axial portion of the motor cover is inserted into the insertion hole of the support pillar in the blower. And, FIG. 24 is a cross-sectional view showing the pivotally coupling mechanism of the blower.

In the present embodiment, an engagement tab 293*a* protruding in an outer side of a radial direction is formed at a distal end, in an axial direction, of the axial portion(s) 293 of the motor cover 29. This engagement tab 293*a* is formed at a part of the distal end, in the axial direction, of the axial portion(s) 293 to have an arc shape.

In addition, an arc-shaped protrusion 332*a* protruding inward is formed on an inner circumference of the insertion hole 332 of the support pillar(s) 33 such that its portion is cut out. And, a cutout 332*b* is formed on the inner circumference of the insertion hole 332 at the position where the arc-shaped protrusion 332*a* is not formed. The cutout 332*b* has a size through which the engagement tab 293*a* can pass when the support pillar 33 is shifted in the axial direction with respect to the motor cover 29.

Therefore, when attaching to the support pillar(s) 33 to the motor cover 29 in the present embodiment, the axial portion 293 is firstly inserted into the insertion hole 332 to bring a state shown in FIG. 23 from a state shown in FIG. 22 where the engagement tab 293*a* faces to the cutout 332*b*.

Then, after the state shown in FIG. 23 is brought, the arc-shaped protrusion 332*a* faces to the engagement tab 293*a* by rotating the motor cover 29 in a direction shown by an arrow show in FIG. 23.

According to this, at least in the state where the blower unit 2 is being swung within its swingable range, the arc-shaped protrusion 332*a* contacts with the engagement tab 293*a* when the support pillar 33 displaces in a direction so as to be pulled out from the motor cover 29, and thereby the support pillar 33 can be restricted from being pulled out from the motor cover 29 (see FIG. 23).

Further, a flange 294*b* expanded outward in the radial direction is formed along an end edge, in the axial direction, of the lock portion 294 formed on the motor cover 29 in the present embodiment. This flange 294*b* is formed along an entire of the arc-shaped lock position 294.

And, while swinging the blower unit 2, this flange 294*b* also moves within the slit 334 of the support pillar 33.

Further, a protrusion 334*a* is provided within the slit 334 of the support pillar 33, and the protrusion 334*a* and the flange 294*b* are faced to each other in the axial direction at least in the state where the blower unit 2 is being swung within its swingable range.

According to this, at least in the state where the blower unit 2 is being swung within its swingable range, the protrusion 334*a* contacts with the flange 294*b* when the support pillar 33 displaces in the direction so as to be pulled out from the motor cover 29, and thereby the support pillar 33 can be restricted from being pulled out from the motor cover 29 (see FIG. 23).

According to this, the pivotally coupling mechanism 50 is configured of the arc-shaped protrusion(s) 332*a* and the engagement tab(s) 293*a*, the protrusion(s) 334*a*, and the flange(s) 294*b* in the present embodiment.

Lateral Swing Mechanism

In addition, the blower 1 includes the lateral swing mechanism 60 in the present embodiment as explained above such that the blower 1 is configured to swing laterally. Hereinafter, the lateral swing structure will be explained by using FIG. 25 and FIG. 26. Note that FIG. 25 is a cross-sectional view showing the lateral swing mechanism of the blower, and FIG. 26 is an exploded perspective view of the blower when being viewed from its bottom side.

Figure 25:
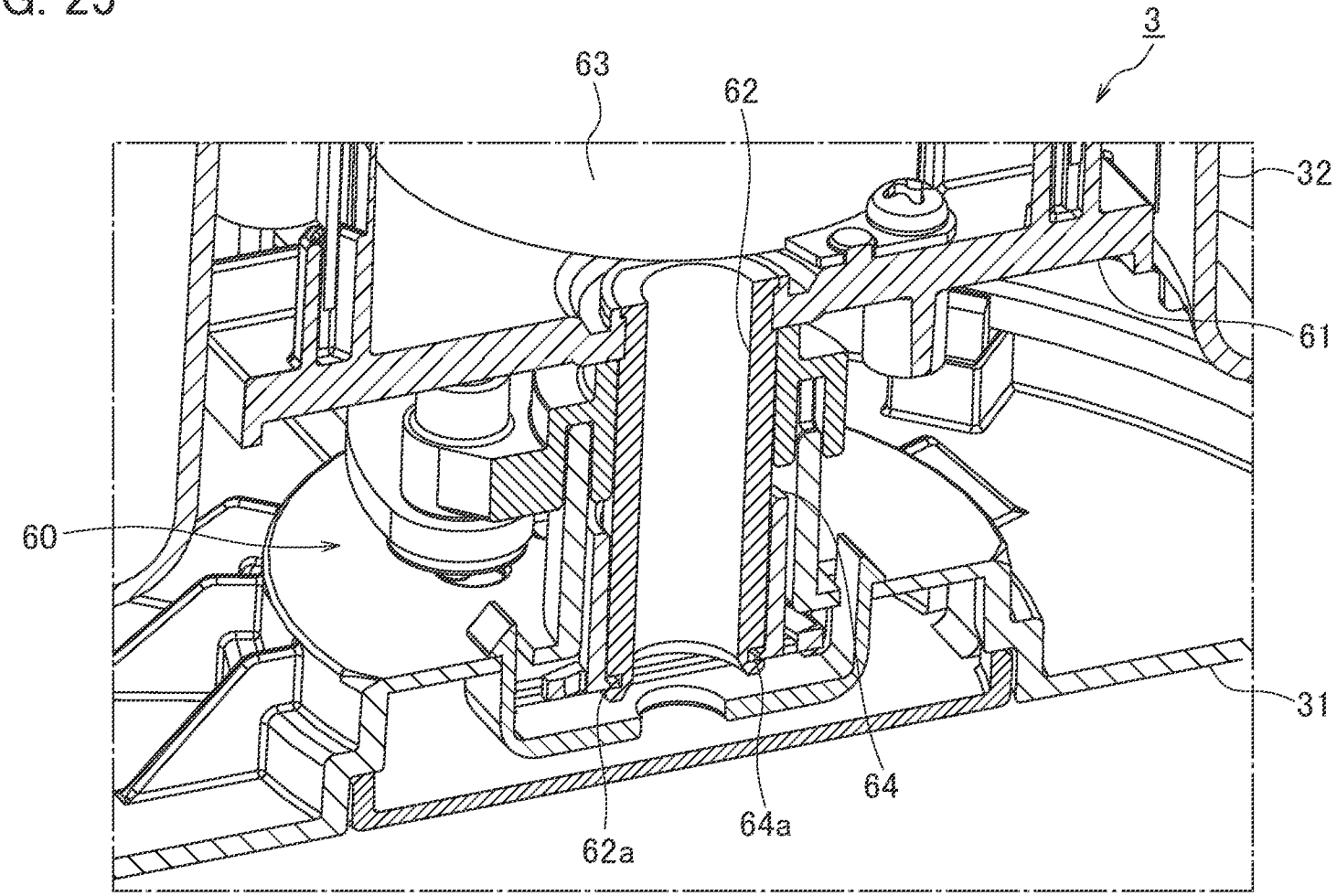
FIG. 25 It is a cross-sectional view showing a lateral swing mechanism of the blower according to the present embodiment.

As shown in FIG. 25, the void space is provided in the support unit 3, and the lateral swing mechanism 60 is accommodated in the void space. The lateral swing mechanism 60 includes a fixed plate 61 that is made of plastics and fixed with the base upper portion 32, a center shaft 62 made integrated with the fixed plate 61 by insert-molding, and a lateral swing motor 63 fixed on an upper surface of the fixed plate 61. In addition, the lateral swing mechanism 60 includes a shaft receiving member (bush) 64 that is made of plastics and into which a lower end of the center shaft 62 is inserted, and an engagement pawl 64*a* is integrally formed along a lower-end inner circumference of the shaft receiving member 64. A notched groove 62*a* is formed along a lower-end outer circumference of the center shaft 62, and the engagement pawl 64*a* is pressed into the notched groove 62*a*.

Figure 26:
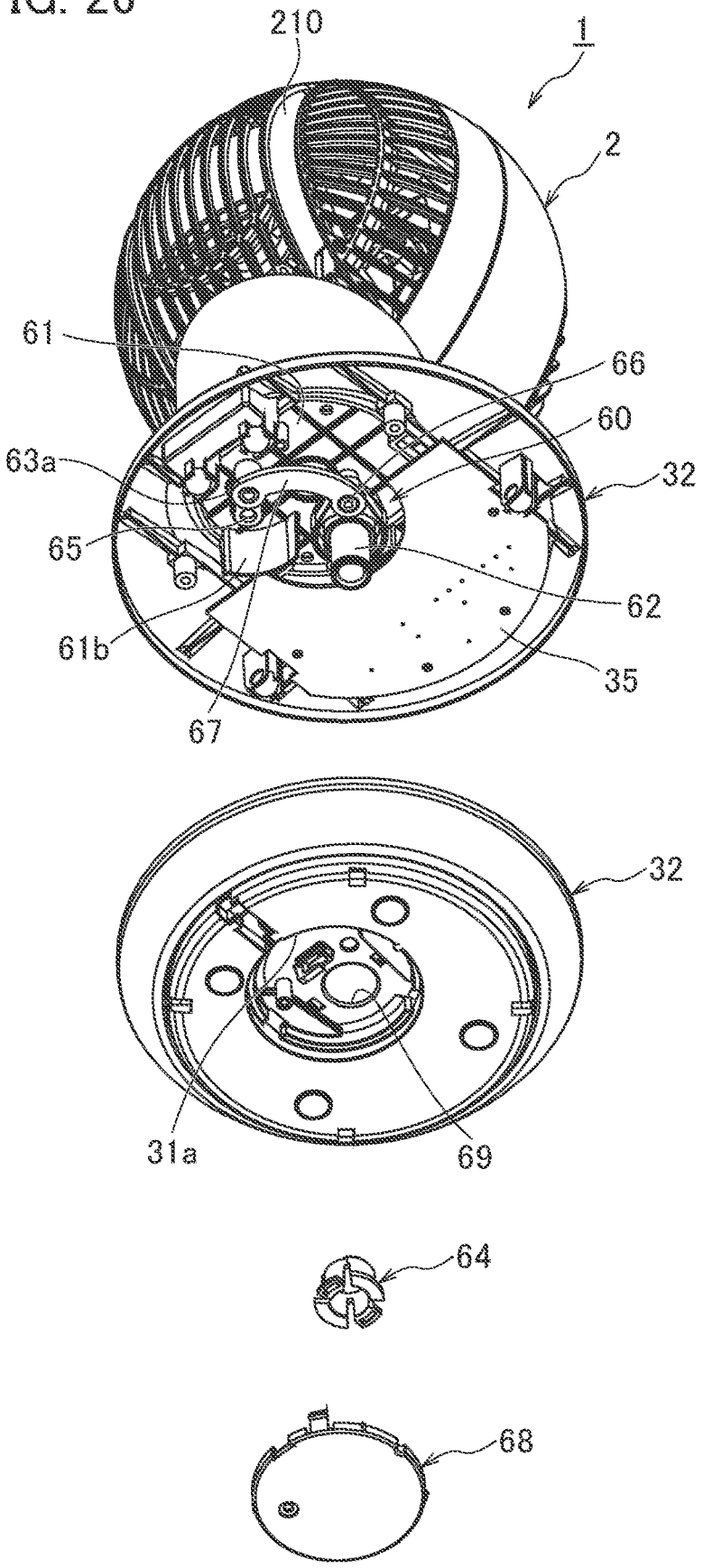
FIG. 26 It is an exploded perspective view of the blower according to the present embodiment when being viewed from its bottom side.

In addition, the void space is provided in the support unit 3, and the lateral swing mechanism 60 is accommodated in the void space (see FIG. 26). The lateral swing mechanism 60 includes the fixed plate 61, the lateral swing motor 63 fixed on the upper surface of the fixed plate 61 (see FIG. 25), an eccentric cam 65 fixed with an output shaft 63*a* of the lateral swing motor 63, a fixed shaft 66 fixed with the base lower portion 31, and a bow-shaped coupling link 67 whose one end is pivotally coupled with the eccentric cam 65 and whose another end is pivotally coupled with the fixed shaft 66.

In addition, the fixed plate 61 is fixed with the base upper portion 32, and the center shaft 62 is swivelably inserted into the shaft receiving member 64. The lateral swing motor 63 (including the eccentric cam 65 fixed with its output shaft 63*a*) and the fixed shaft 66 are provided at a position distanced from the center shaft 62.

Further, the hollow cylindrical shaft receiving member 64, along whose lower-end inner circumference the engagement pawl 64*a* is formed, is inserted into a shaft insertion hole 69 formed on the base lower portion 31. The center shaft 62 is inserted into this shaft receiving member 64. And, the notched groove 62*a* is formed on the lower-end outer circumference of the center shaft 62, and the engagement pawl 64*a* that serves as an engagement flange is pressed into the notched groove 62*a*. And, an opening 31*b* formed on a lower plate of the base lower portion 31 is closed by a bottom cap 68.

Furthermore, the fixed plate 61 and an upper end of the center shaft 62 are insert-molded with each other, and the base upper portion 32 and the base lower portion 31 are coupled with each other by the center shaft 62 and the shaft receiving member 64 for the center shaft 62 is fixed with the base lower portion 31. Since the center shaft 62 is inserted into the shaft insertion hole 69 with the shaft receiving member 64 interposed therebetween, no clearance is formed between the center shaft 62 and the shaft insertion hole 69 to prevent frictions with the shaft insertion hole 69 due to swinging of the center shaft 62 and noises generated by them and to smoothen the swinging of the base upper portion 32 (the blower unit 2) about the center shaft 62.

When a user turns on the lateral swinging by pressing down the swing button on the control panel 323, the eccentric cam 65 fixed with the output shaft 63*a* of the lateral swing motor 63 rotates eccentrically, and the one end of the coupling link 67 pivotally coupled with the eccentric cam 65 moves in a circular motion. Since the other end of the coupling link 67 is pivotally coupled with the fixed shaft 66 fixed with the base lower portion 31, the base upper portion 32 and the blower unit 2 attached thereon swivel (swing) about the center shaft 62 in the lateral direction due to the circular motion according to a radius distance of the circular motion.

As explained above, the blower 1 according to the present embodiment is the blower 1 in which the base lower portion 31 and the base upper portion 32 that is provided swingably on the base lower portion 31 are coupled with each other with the center shaft 62 passed through them and the blower unit 2 is provided on the base upper portion 32; the shaft receiving member 64 is inserted into the base lower portion 31; the center shaft 62 is swivelably inserted into the shaft receiving member 64; and the fixed plate 61 provided in the base upper portion 32 and the upper end of the center shaft 62 are insert-molded with each other. According to this, it becomes possible to reduce the number of components and production costs while ensuring strength of the joint portion thereof.

In addition, the fixed plate 61 provided in the base upper portion 32 is made of plastics. According to this, the electrical wire(s) can be prevented from being damaged when the electrical wire contacts with edges (corners) of the fixed plate 61.

Further, the engagement pawl 64*a* is integrally molded of plastics on the lower-end inner circumference of the shaft receiving member 64 for the center shaft 62. According to this, the engagement pawl 64*a* functions as an alternative of an E-ring, so that it is not needed to use an E-ring and thereby it becomes possible to reduce the number of components and production costs.

Note that bolls (rollers) B coupled with the base upper portion 32 slide on a rail (running path) R, and thereby the base upper portion 32 (the blower unit 2) swivels (swings) in the lateral direction (see FIG. 9).

Routing Structure for Electrical Cable

In addition, routing of an electrical cable 91 is drawn out from the axial portion 293. Hereinafter, the routing structure of the electrical cable will be explained by using FIG. 27 and FIG. 28. Note that FIG. 27 is a perspective view showing the routing state of the electrical cable of the blower, and FIG.

28 is a perspective view showing the routing state of the electrical cable of the blower when being viewed from its bottom side.

Figure 27:
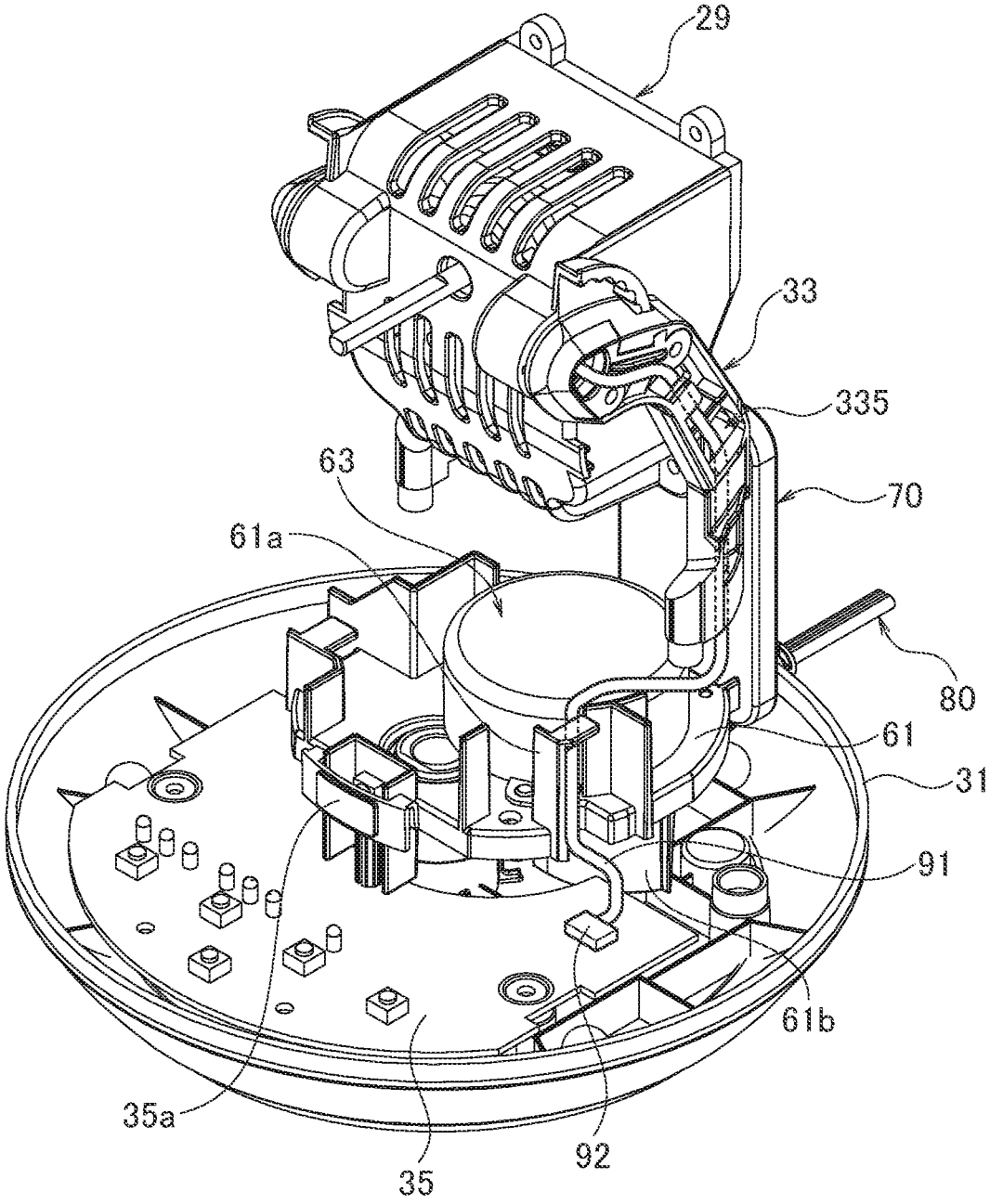
FIG. 27 It is a perspective view showing a routing state of an electrical cable of the blower according to the present embodiment.
Figure 28:
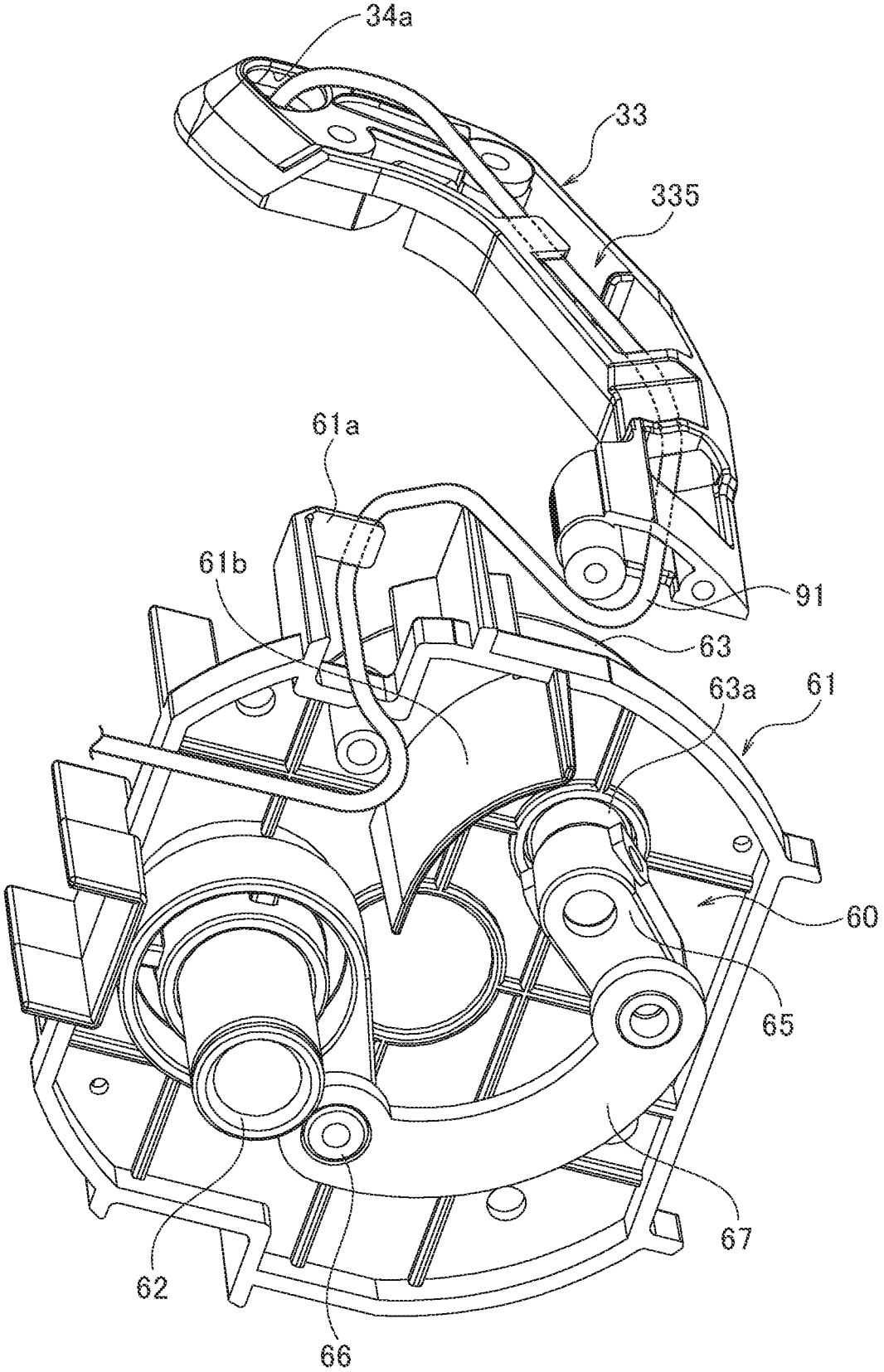
FIG. 28 It is a perspective view showing the routing state of the electrical cable of the blower according to the present embodiment when being viewed from its bottom side.

In the present embodiment, as shown in FIG. 27 and FIG. 28, the motor cover 29 is held from its both sides by support pillars 33 raised up from the support unit 3, and the blower unit 2 swings vertically with respect to the support unit 3 about this held position as the swing axis C of the vertical swinging.

Further, the tubular axial portions 293 formed on the motor cover 29 function as the swing axis C of the vertical swinging.

Here in the present embodiment, the electrical cable 91 connected to the motor 28 for driving the fan 27 accommodated in the motor cover 29 is drawn out through the axial shaft for the vertical swinging (the axial portion 293).

The electrical cable 91 drawn out through axial shaft for the vertical swinging (the axial portion 293) is also drown outward through an insertion hole 34*a* of the drop restriction cover 34, and then accommodated in a recess 335 formed on the support pillar 33.

In addition, in the present embodiment, the recess 335 communicates with the void space in the main body of the support unit 3 in a state where the support pillar 33 is held on the main body of the support unit 3, and the electrical cable 91 is drawn out through this communicated portion into the void space in the main body while being placed in the recess 335.

Further, as shown in FIG. 27, a hook-shaped rib 61*a* protruding upward is formed on an upper portion of the fixed plate 61 in the present embodiment, and the electrical cable 91 drawn out through the communicated portion into the void space in the main body is held by the hook-shaped rib 61*a*.

And, the electrical cable 91 is drawn out below the fixed plate 61 in a state of being held by the hook-shaped rib 61*a*, and an end of the electrical cable 91 drawn out below the fixed plate 61 is electrically connected with a connector 92 mounted on the circuit board 35.

Here, as shown in FIG. 28, a rib 61*b* protruding downward if formed on the bottom face of the fixed plate 61, and a loose portion of the electrical cable 91 can be restricted by the rib 61*b* from being electrically disconnected due to contacts with the link mechanism of the lateral swing mechanism 60.

According to the above configuration for routing the electrical cable 91, no twisting force is applied to the electrical cable 91 during the vertical swinging and thereby the electrical cable 91 can be prevented from being electrically disconnected more surely.

One Example of In-Use State

Next, an in-use example of the above blower 1 will be explained. Note that FIG. 29 is a perspective view showing the one example of the in-use state of the blower 1.

Figure 29:
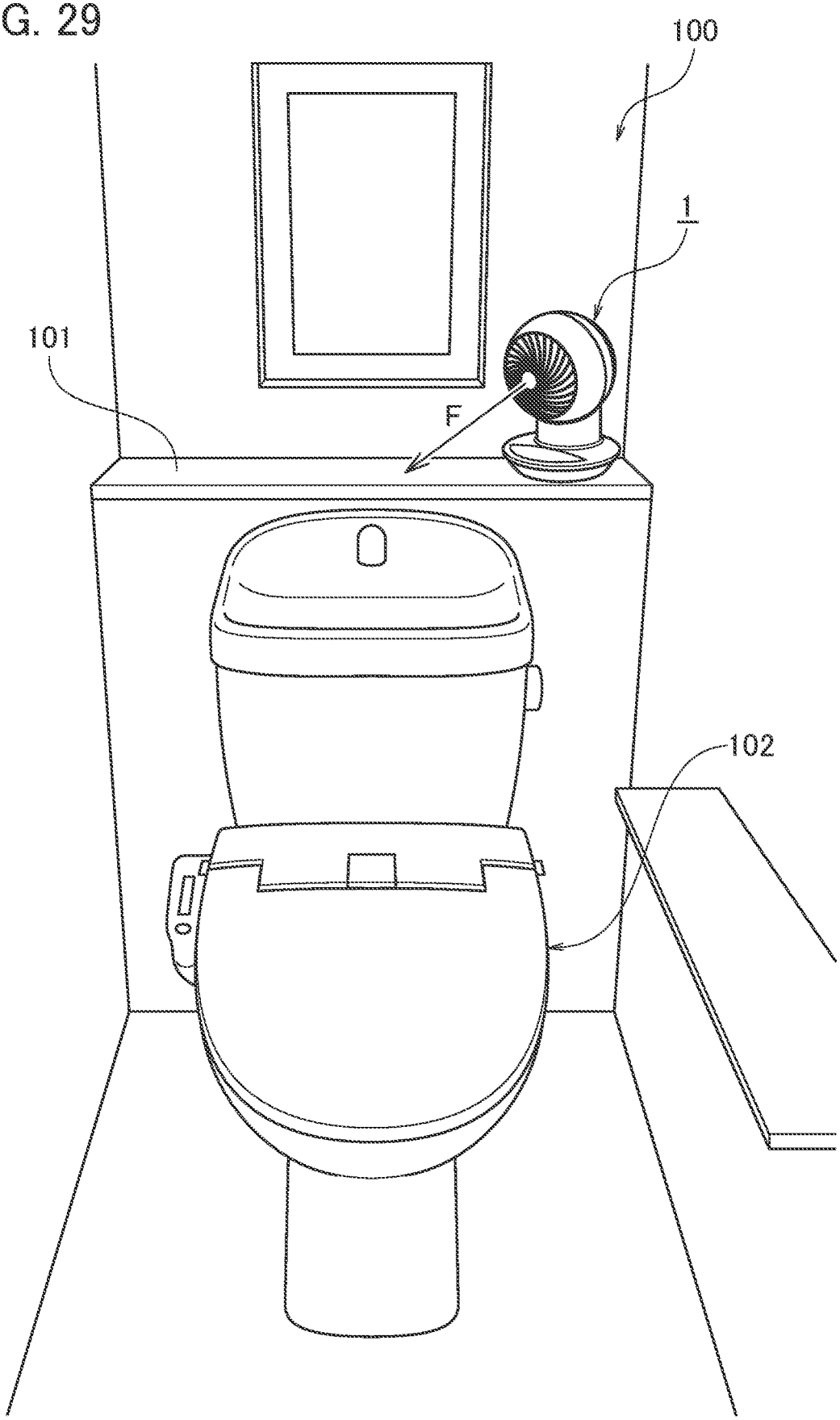
FIG. 29 It is a perspective view showing one example of an in-use state of the blower according to the present embodiment.

As shown in FIG. 29, the blower 1 according to the present embodiment can be used by being placed on a shelf 101 formed in a home toilet 100, for example. When the blower 1 is placed on the shelf 101 in this manner, it is preferable that it is used in a state where the blower unit 2 is swung such that its airflow direction F is directed downward from the horizontality. According to this, the airflow from the blower 1 can be directed toward a side of a lavatory pan 102 that positions below the shelf 101.

Note that, for example, it is possible to use the blower 1 according to the present embodiment such that it is placed on a shelf in an undressing room and it generates airflow directed toward a lower side below the horizontality.

MODIFIED EXAMPLES

Figure 30:
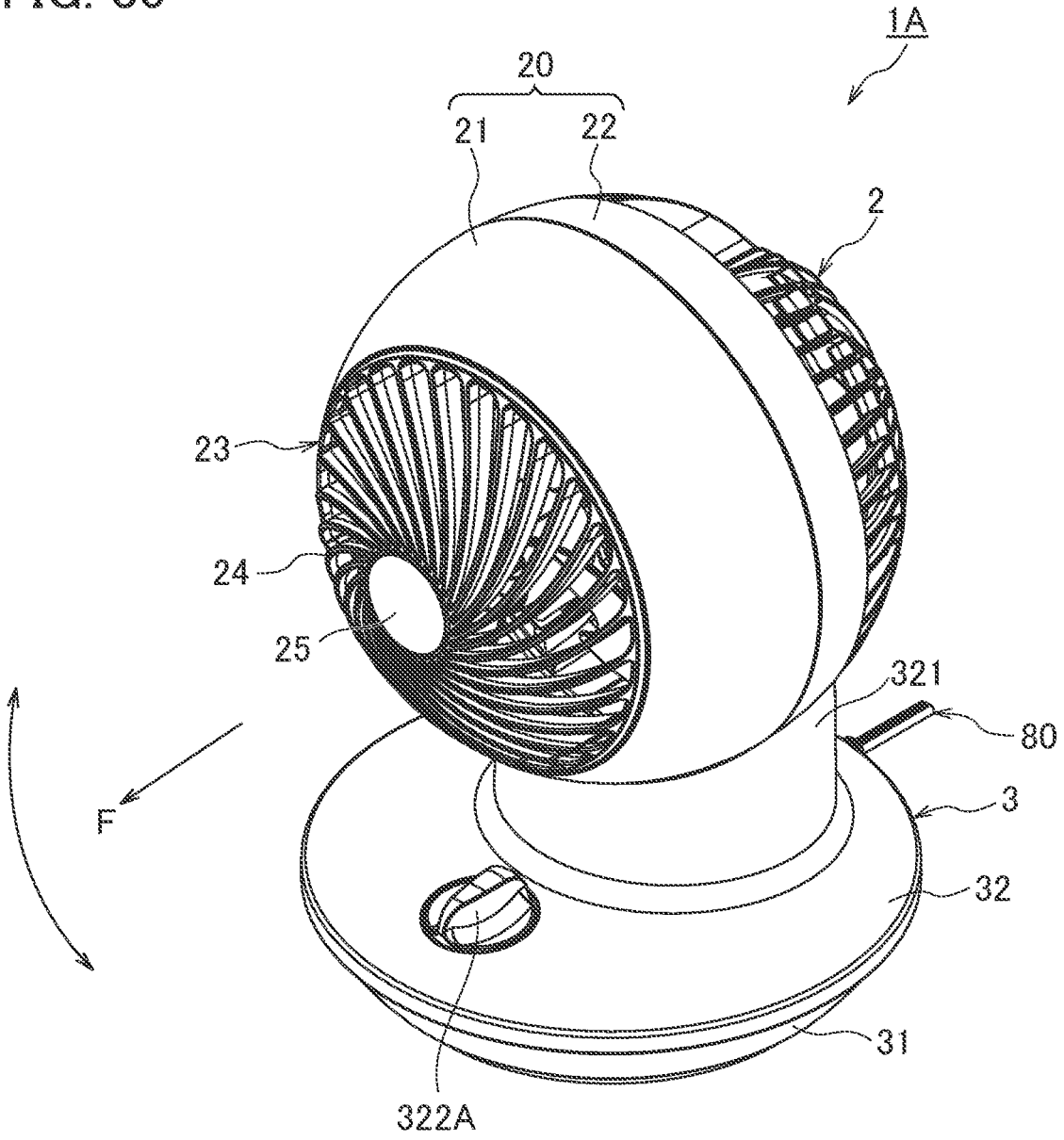
FIG. 30 It is a perspective view showing a first modified example of the blower according to the present embodiment.

In addition, a blower is not limited to the above-explained blower 1, and may be a blower 1A shown in FIG. 30, for example Note that FIG. 30 is a perspective view showing a first modified example of the blower.

As shown in FIG. 30, in this blower 1A, a switch 322A that is to be operated manually is provided. Specifically, in the blower 1A shown in FIG. 30, changing on/off of its power source and adjustment of it volume rate of the airflow of the blower unit 2 are done by manually rotating the switch 322A.

And, the blower 1A like this can be configured such that its blower unit 2 is swung so as to direct an airflow direction F of the blower unit 2 toward a lower side below the horizontal direction similarly to the blower 1 shown in the above embodiment.

Figure 31:
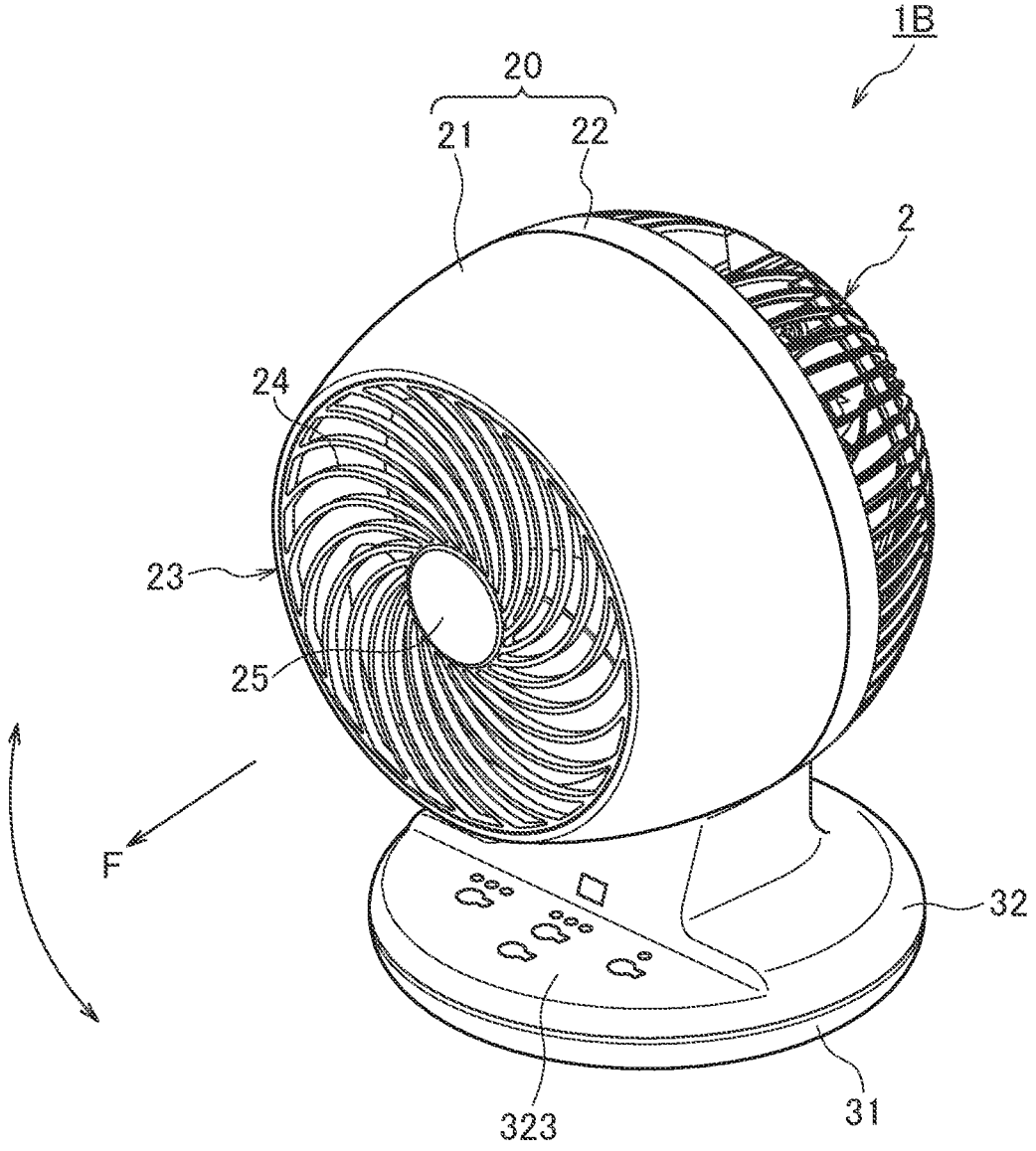
FIG. 31 It is a perspective view showing a second modified example of the blower according to the present embodiment.

In addition, a blower can be a blower 1B shown in FIG. 31, for example. Note that FIG. 31 is a perspective view showing a second modified example of the blower.

As shown in FIG. 31, this blower 1B is an air circulator that includes a flat grill structure. In other words, it includes a blower unit 2 that is formed such that its outline shape is formed to have a barrel shape, and a flat grill 23 is provided in a circular airflow opening 2*a* opened toward its front. Similarly, this flat grill 23 also has plural fins 24 in a spiral manner.

And, the blower 1B like this can be configured such that its blower unit 2 is swung so as to direct an airflow direction F of the blower unit 2 toward a lower side below the horizontal direction similarly to the blower 1 shown in the above embodiment.

Other Embodiments

Some embodiments are explained as described above, the descriptions and the drawings that are part of the disclosures are examples, and you should not think that they provide limitations. Based on these disclosures, various alternative embodiments, practical examples and operational technologies may be made known for person skilled in the art.

As explained above, the present embodiment includes various embodiments not described here.

The present application claims priority based on the Japanese Patent Application No. 2018-192033, filed on Oct. 10, 2018, and entire contents of this application is incorporated into the Descriptions of the present application by reference.

INDUSTRIAL APPLICABILITY

According to the present embodiment, it become possible to provide a blower that can send airflow downward below the horizontal direction while making the device compact.

EXPLANATIONS OF SIGNS

C swing axis
D1 distance
D2 predetermined clearance
F airflow direction
blower
blower unit
2*a* airflow opening cover (housing)
20*a* spherical shape
front cover
rear cover
210 slit
210*a* lower end
211*c* inner face
212 rib
293 axial portion
293*a* engagement tab (pivotally coupling mechanism 50)
294*a* concave notch (angle adjustment mechanism 40)
294*b* flange (pivotally coupling mechanism 50)
support unit
322*a* concave spherical surface
support pillar
331 notch
332*a* arc-shaped protrusion (pivotally coupling mechanism 50)
334*a* protrusion (pivotally coupling mechanism 50)

The invention claimed is:

1. A blower comprising:

a blower unit that has a housing defining a slit therein which extends vertically; and a support unit that has a support pillar inserted through the slit and pivotally coupled with the blower unit to make the blower unit swingable vertically, wherein a space is present between a lower end of the slit and the support pillar when the blower unit is positioned in a horizontally directed state in which an airflow direction of the blower unit is in line with a horizontal direction, wherein the blower unit is configured to swing such that the airflow direction of the blower unit is directed toward a lower side below the horizontal direction, and wherein a rib protruding in a width direction of the slit is on an inner face of the slit.

2. The blower according to claim 1, wherein the housing has a front cover and a rear cover that are dividable at a center of the blower unit, and the slit is defined from a lower face to an upper face through a back face of the rear cover.

3. The blower according to claim 2, wherein the support pillar is disposed closer to a rear end of the support unit than a front end of the support unit.

4. A blower comprising:

a blower unit that has a housing defining a slit which extends vertically; and a support unit that has a support pillar inserted through the slit and pivotally coupled with the blower unit to make the blower unit swingable vertically, wherein the support pillar includes a base portion raised upward on the support unit and inserted through the slit, and a pivotally coupling portion that is disposed on a front side from the base portion and on which is defined an insertion hole into which an axial portion of the blower unit is inserted, wherein the pivotally coupling portion is configured to support the axial portion from a rear side, and wherein a lower end of the slit is positioned below the axial portion of the blower unit, and a space is present between the lower end of the slit and the base portion of the support pillar when the blower unit is positioned in a horizontally directed state in which an airflow direction of the blower unit is in line with a horizontal direction, wherein the blower unit is configured to swing such that the airflow direction of the blower unit is directed toward a lower side below the horizontal direction.

5. The blower according to claim 4, wherein the housing has a front cover and a rear cover that are dividable at a center of the blower unit, and the slit is defined from a lower face to an upper face through a back face of the rear cover.

6. The blower according to claim 5, wherein the support pillar is disposed closer to a rear end of the support unit than a front end of the support unit.

7. A blower comprising:

a blower unit that has a housing defining a slit therein which extends vertically, and the blower unit includes a lock portion protruding in a direction of a swing axis thereof;

a support unit that has a support pillar inserted through the slit of the housing and pivotally coupled with the blower unit to make the blower unit swingable vertically; and an angle adjustment mechanism that is configured of a plurality of concave notches on the lock portion, a push pin accommodated in the support pillar, and a spring configured to urge the push pin toward the plurality of concave notches, and wherein the support pillar has a slit in which the lock portion is movable, and the push pin is pressed onto one of the plurality of concave notches in the slit of the support pillar.

8. The blower according to claim 7, wherein the housing has a front cover and a rear cover that are dividable at a center of the blower unit, and the slit of the housing is defined from a lower face to an upper face through a back face of the rear cover.

9. The blower according to claim 8, wherein the support pillar is disposed closer to a rear end of the support unit than a front end of the support unit.

10. A blower comprising:

a blower unit that has a housing defining a slit therein which extends vertically;

a support unit that has a support pillar inserted through the slit of the housing and pivotally coupled with the blower unit to make the blower unit swingable vertically; and a pivotally coupling mechanism that is configured to restrict release of a pivotally coupled state of the blower unit and the support pillar, wherein the pivotally coupling mechanism has a lock portion protruding from the blower unit in a direction of a swing axis thereof, a flange along an end edge of the lock portion, a slit that is on the support pillar and in which the flange is movably inserted, and a protrusion provided in the slit of the support pillar, and wherein the support pillar is restricted from being pulled out from an axial portion of the blower unit by rotating the support pillar such that the protrusion and the flange are facing each other in the direction of the swing axis.

11. The blower according to claim 10, wherein the housing has a front cover and a rear cover that are dividable at a center of the blower unit, and the slit of the housing is defined from a lower face to an upper face through a back face of the rear cover.

12. The blower according to claim 11, wherein the support pillar is disposed closer to a rear end of the support unit than a front end of the support unit.

13. A blower comprising:

a blower unit that has a housing defining a slit therein which extends vertically; and a support unit that has a support pillar inserted through the slit and pivotally coupled with the blower unit to make the blower unit swingable vertically, wherein the support pillar includes a vertical portion that is raised upward on the support unit and inserted through the slit, an inclined portion extended from an upper end of the vertical portion obliquely forward and upward, and a pivotally coupling portion that is extended forward from an end of the inclined portion and has an insertion hole into which an axial portion of the blower unit is inserted, wherein the pivotally coupling portion is disposed forward of an area where the vertical portion is extended upward, wherein a lower end of the slit is positioned vertically below the axial portion of the blower unit, and a space is present between the lower end of the slit and the vertical portion of the support pillar that is inserted through the slit when the blower unit is positioned in a horizontally directed state in which an airflow direction of the blower unit is in line with a horizontal direction, wherein the blower unit is configured to swing such that the airflow direction of the blower unit is directed toward a lower side below the horizontal direction.

14. The blower according to claim 13, wherein the housing has a front cover and a rear cover that are dividable at a center of the blower unit, and the slit is defined from a lower face to an upper face through a back face of the rear cover.

15. The blower according to claim 14, wherein the support pillar is disposed closer to a rear end of the support unit than a front end of the support unit.

* * * * *